US006023896A

United States Patent [19]

Rothschild

[11] Patent Number: 6,023,896

[45] Date of Patent: Feb. 15, 2000

[54] MODULAR PARTITION SYSTEMS AND METHODS FOR ASSEMBLING SUCH SYSTEMS

[75] Inventor: Shlomo Rothschild, Karmiel, Israel

[73] Assignee: Finish Group Ltd., Kiryat Ata, Israel

[21] Appl. No.: 09/138,401

[22] Filed: Aug. 24, 1998

[51] Int. Cl.[7] ..... E04H 1/00

[52] U.S. Cl. ..... 52/243.1; 52/745.1

[58] Field of Search ..... 52/243.1, 745.1, 52/126.4, 489.1, 481.2, 287.1, 127.2, 127.8

[56] References Cited

U.S. PATENT DOCUMENTS

| | | | |
|---|---|---|---|
| 3,017,969 | 1/1962 | Nielsen . | |
| 3,583,466 | 6/1971 | Dreyer . | |
| 3,686,810 | 8/1972 | Allen . | |
| 3,875,711 | 4/1975 | Palmer . | |
| 3,998,018 | 12/1976 | Hodges . | |
| 4,085,789 | 4/1978 | Steiner . | |
| 4,100,709 | 7/1978 | Good . | |
| 4,185,948 | 1/1980 | Maguire . | |
| 4,349,995 | 9/1982 | Dowler et al. | 52/241 |
| 4,468,067 | 8/1984 | Jenkins . | |
| 4,597,140 | 7/1986 | Girard . | |
| 4,597,690 | 7/1986 | Girard . | |
| 4,874,027 | 10/1989 | Boundy . | |
| 5,081,808 | 1/1992 | Bastian et al. . | |
| 5,219,406 | 6/1993 | Raz . | |
| 5,715,633 | 2/1998 | Raz et al. | 52/220.7 |
| 5,819,498 | 10/1998 | Geraci | 52/745.1 |

FOREIGN PATENT DOCUMENTS

| | | |
|---|---|---|
| PCT/US92/11174 | 7/1993 | WIPO . |
| PCT/US96/17994 | 5/1997 | WIPO . |

*Primary Examiner*—Christopher T. Kent
*Assistant Examiner*—Nkeisha J. Maddox
*Attorney, Agent, or Firm*—Mark M. Friedman

[57] ABSTRACT

A modular partition system includes at least two relocatable panel units. Each panel unit has a frame formed from two horizontal frame elements and two vertical frame elements interconnected so as to define a rectangular opening, and at least one panel mounted within the opening. The system also includes at least one connector for rigidly connecting adjacent vertical frame elements from the panel units to combine them to form a partition. The vertical frame elements are configured to provide attachment portions accessible from the front of the panel unit for receiving the connectors so that the panel units may be connected without dissembling them. Also described is a method for assembly of a partition employing a rigid template for alignment.

13 Claims, 28 Drawing Sheets

Fig. 16a
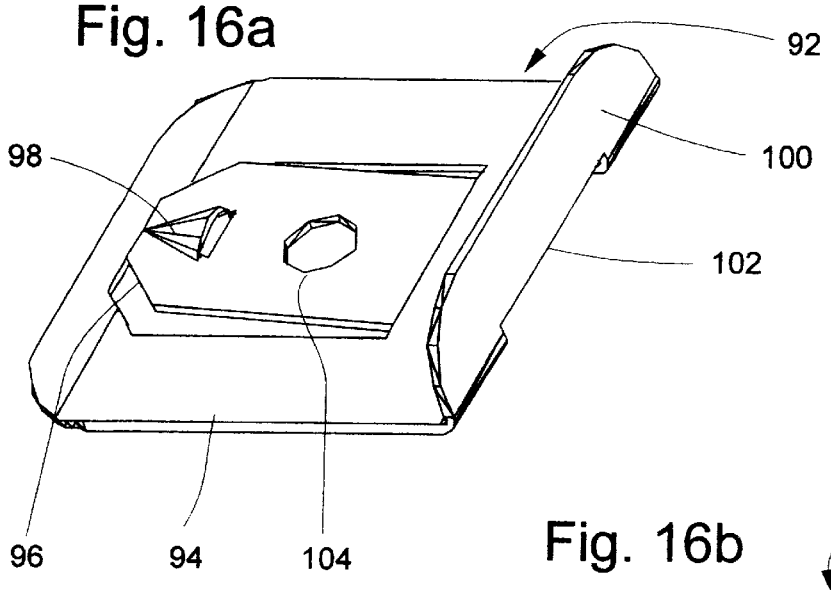
Fig. 16b
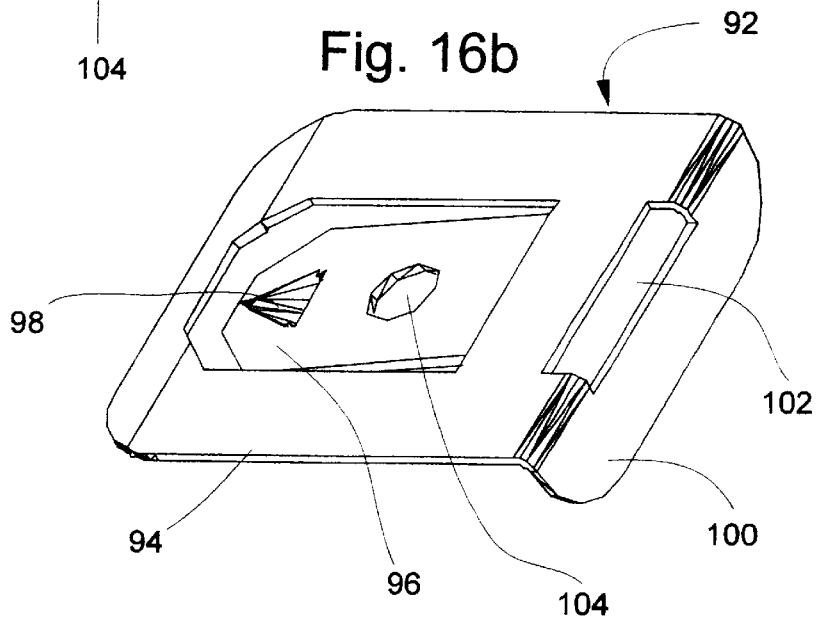
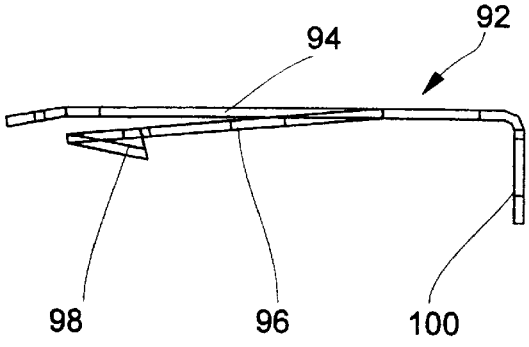
Fig. 16c
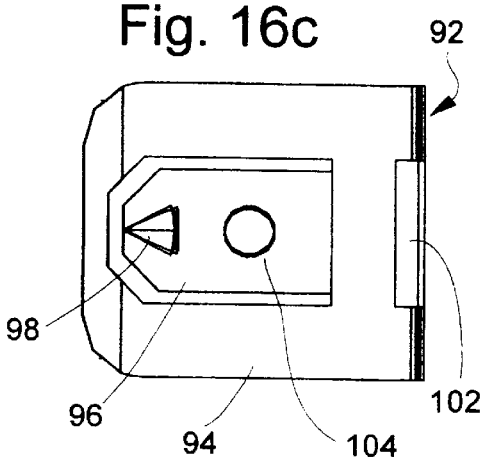
Fig. 16d

MODULAR PARTITION SYSTEMS AND METHODS FOR ASSEMBLING SUCH SYSTEMS

FIELD AND BACKGROUND OF THE INVENTION

The present invention relates to partitions and, in particular, it concerns modular partition systems and corresponding methods for assembling such systems.

It is known to employ partitions of various kinds to subdivide a space, typically an office or dwelling space. The most common partition structure has a framework constructed from metal tracks attached to the floor and ceiling between which vertical posts are aligned. Plasterboard or other paneling material is then cut to size and attached to the framework and the surface is finished, typically by application of plaster and paint or textile finishing.

The structure described has a number of major drawbacks. Firstly, it requires the skilled labor of several different workers. A skilled builder is required to align the lower and upper tracks, to align the vertical posts and to cut the panels to size. When electrical installation in required, an electrician must be involved in running wires and fitting sockets etc. A further worker is usually required for finishing the surface.

A further drawback is the inflexibility of the structure. Since all components are typically cut to size on site, they are usually not reusable. As a result, if a partition is to be moved, the labor and material costs are generally similar to those of constructing a new partition. Similarly, even if only rewiring is required, extensive dissembly and coordinated labor of different categories is usually required.

An alternative partition construction employs modular frame units which can be connected together to form a partition frame of various dimensions. Once the internal connections between the frame units have been made, standard size ready-finished panels are attached. Examples of such a system may be found in U.S. Pat. Nos. 5,219,406 and 5,715,633.

Clearly, this modular structure ensures that the components are reusable when the partition is moved from one location to another. The modular structure may also provide easily removable panels to allow relatively low labor rewiring and the like. However, this structure suffers from its own limitations. Specifically, since connections between the units are internal, dissembly and reassembly requires removal and subsequent refitting of the panels. Furthermore, the standard sizes of the units renders the structure unsuited for constructing floor-to-ceiling partitions where the partition must conform to a wide range of different height dimensions.

Finally, an additional shortcoming common to all conventional partition systems, whether "built-to-measure" or modular in construction, relates to the time-consuming leveling procedures involved in their assembly. Each vertical post or modular unit is first positioned and then carefully aligned to stand vertically. Since the alignment procedure must be repeated for each element the assembly procedure as a whole is rendered highly inefficient.

There is therefore a need for modular partition systems and corresponding methods of assembly which would simplify and speed up the procedure of assembling a partition. It would also be highly advantageous to provide a highly adaptable modular partition system suited to floor-to-ceiling applications and which could be dissembled and reassembled without taking apart the modular panel units.

SUMMARY OF THE INVENTION

The present invention is a modular partition system and a method for assembling such a system.

According to the teachings of the present invention there is provided, a modular partition system comprising: (a) at least two relocatable panel units, each of the panel units including: (i) a substantially rectangular frame formed from two substantially horizontal frame elements and two substantially vertical frame elements interconnected so as to define a substantially rectangular opening, and (ii) at least one panel mounted within the opening; and (b) at least one connector for rigidly connecting adjacent ones of the substantially vertical frame elements from the at least two panel units so as to combine the panel units to form a partition, wherein the substantially vertical frame elements are configured to provide attachment portions accessible from the front of the panel unit for receiving the at least one connector such that connection of the panel units may be achieved without dissembly of the panel units.

According to a further feature of the present invention, each of the attachment portions includes at least one flange deployed vertically and in a plane substantially perpendicular to a plane of the opening, and wherein the at least one connector is implemented as a plurality of connector brackets configured for engaging two of the flanges. One or more of the connector brackets may be implemented as a projecting connector bracket configured to project outwards from the partition system to support at least one partition accessory.

According to a further feature of the present invention, each of the connector brackets includes a spacer projection for insertion between the two flanges so as to produce a pre-defined clearance gap between the flanges.

According to a further feature of the present invention, each of the two flanges features at least one profiled cut-out configured to provide upper and lower abutment surfaces for abutting corresponding surfaces of the connector brackets such that engagement of the connector brackets within corresponding ones of the profiled cut-outs for two adjacent vertical frame elements locks the flanges against relative vertical movement.

According to a further feature of the present invention, each of the substantially vertical frame elements is formed with at least one vertical channel for housing electrical wiring, the system further comprising a cover element configured for attachment to the substantially vertical frame elements so as to cover the vertical channels.

According to a further feature of the present invention, there is also provided a rigid template configured to temporarily engage at least one of the substantially rectangular frames so as to confine the substantially rectangular frame to a rectangular form during connection of the panel units.

According to a further feature of the present invention, each of the panel units further includes an adjustable base section deployed beneath a lower of the two substantially horizontal frame elements, the adjustable base section having: (a) adjustable support elements adjustable to conform to a gap between the lower substantially horizontal frame element and an underlying surface; and (b) two overlapping plinth elements, a degree of overlap between the overlapping plinth elements varying according to a state of the adjustable support elements, wherein at least one of the overlapping plinth elements is hingedly mounted such that the overlapping plinth element can be swung outwards to provide access to an internal volume of the adjustable base section.

According to a further feature of the present invention, each of the panel units further includes: (a) two telescopic extension elements, each mounted with respect to one of the substantially vertical frame elements so as to be extendible vertically above an upper one of the substantially horizontal frame elements; (b) fastening means for fastening the telescopic extension elements in a desired position relative to the substantially vertical frame elements; and (c) a supplementary substantially horizontal frame element connecting between the two telescopic extension elements such that the supplementary substantially horizontal frame element, the two telescopic extension elements and the upper substantially horizontal frame element form a secondary substantially rectangular opening.

According to a further feature of the present invention, each of the panel units further includes an adjustable upper closure section deployed above the supplementary substantially horizontal frame element, the adjustable upper closure section including: (a) adjustable upper support elements adjustable to conform to a gap between the supplementary substantially horizontal frame element and an overhead surface; and (b) two overlapping plinth elements, a degree of overlap between the overlapping plinth elements varying according to a state of the adjustable upper support elements, wherein at least one of the overlapping plinth elements is hingedly mounted such that the overlapping plinth element can be swung outwards to provide access to an internal volume of the adjustable upper closure section.

According to a further feature of the present invention, each panel unit further includes a plurality of panel clips for retaining the panel within the opening, each of the panel clips including: (a) a substantially sheet-like insertable tab, the tab having a resiliently biased tongue resiliently biased to an out-of-plane position, the tongue featuring a barbed projection; and (b) a clamping tab attached to, or integrally formed with, the insertable tab, the clamping tab projecting laterally from the insertable tab for abutting a front surface of the panel.

According to a further feature of the present invention, each of the panel clips further includes an opening through the panel clip adjacent to the attachment of the clamping tab to the insertable tab, the opening being configured to allow insertion of a tool for removal of the panel clip.

There is also provided according to the teachings of the present invention, a method for assembling a modular partition assembly made up of a plurality of substantially rectangular panel units each having vertical and horizontal frame elements, the method comprising: (a) preparing at least one acceptably aligned vertical element; (b) temporarily attaching a rigid template to one of the panel units so as to form a braced panel unit with improved rectangular geometry; (c) connecting the braced panel unit to the aligned vertical element in a manner such as to align the braced panel unit with the aligned vertical element; (d) fixing at least one support element between a lower portion of the braced panel unit and an underlying surface so as to support the braced panel unit above the underlying surface; and (e) removing the rigid template.

According to a further feature of the present invention, the method of claim further includes: (a) temporarily attaching a second rigid template to a second of the panel units so as to form a second braced panel unit with improved rectangular geometry; (b) connecting the second braced panel unit to the first braced panel unit in a manner such as to align the second braced panel unit with the first braced panel unit; and (c) fixing at least one support element between a lower portion of the second braced panel unit and the underlying surface so as to support the braced panel unit above the underlying surface, wherein the step of removing the rigid template from the first braced panel unit is performed after connecting and fixing at least one support element for the second braced panel unit.

According to a further feature of the present invention, at least one upper support element is fixed between an upper portion of the braced panel unit and an overhead surface.

According to a further feature of the present invention, the connecting of the braced panel unit to the aligned vertical element is performed by insertion of connector brackets from the front of the panel unit so as to engage a vertical frame element of the panel unit.

According to a further feature of the present invention, a cover is attached so as to conceal the connector brackets.

According to a further feature of the present invention, electrical wiring is positioned in at least part of a wiring channel located around the panel unit and covering at least part of the wiring channel with a cover.

BRIEF DESCRIPTION OF THE DRAWINGS

The invention is herein described, by way of example only, with reference to the accompanying drawings, wherein:

FIG. 16A is a first isometric view of a preferred form of a panel clip for securing a panel within the panel unit of FIG. 1;

FIG. 16B is a second isometric view of the panel clip of FIG. 16A;

FIG. 16C is a plan view of the panel clip of FIG. 16A;

FIG. 16D is a side view of the panel clip of FIG. 16A;

DESCRIPTION OF THE PREFERRED EMBODIMENTS

Figure 1:
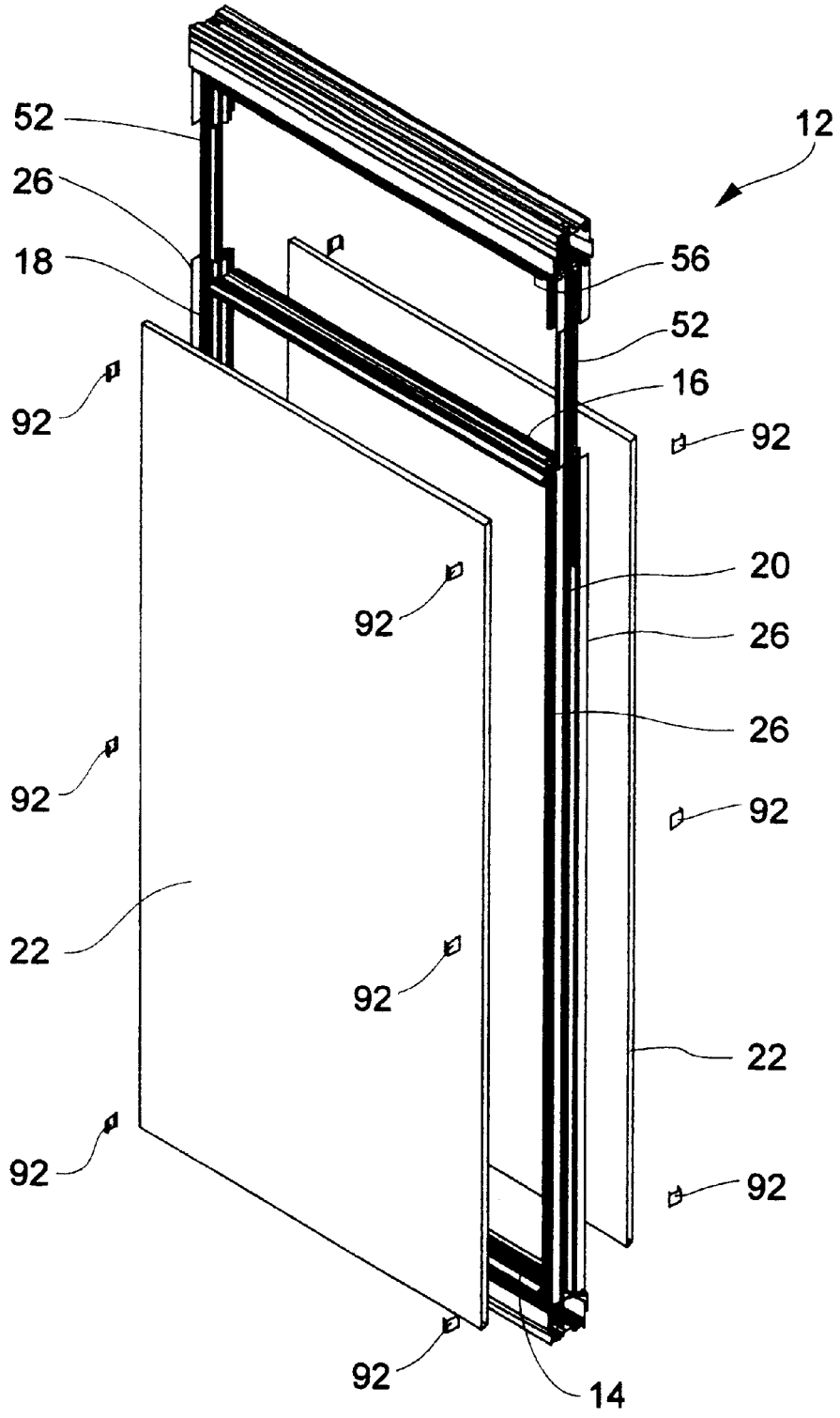
FIG. 1 is an isometric view of a relocatable panel unit from a modular partition system, constructed and operative according to the teachings of the present invention, at a first stage of assembly.
Figure 2:
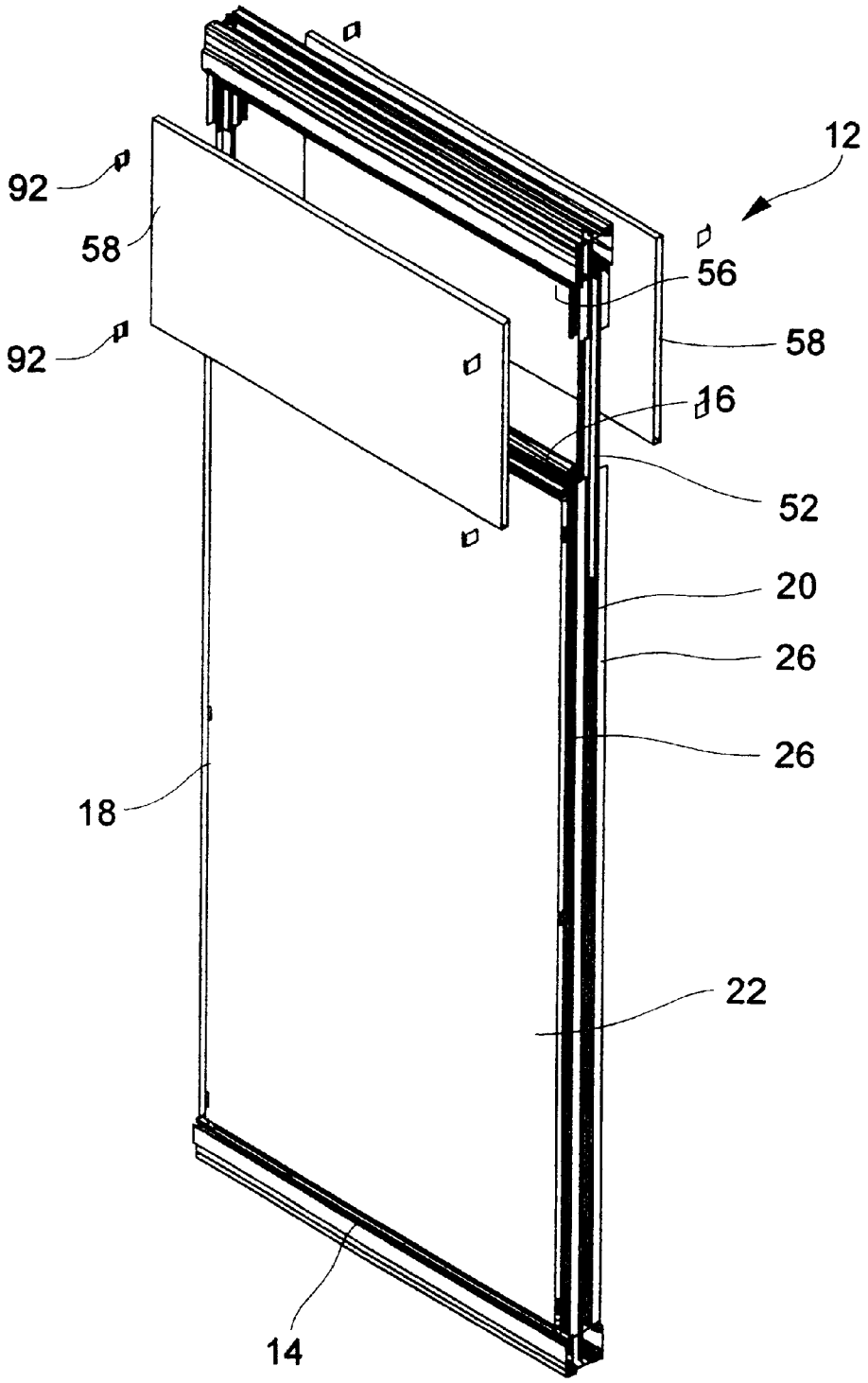
FIG. 2 is an isometric view of the relocatable panel unit of FIG. 1 at a second stage of assembly.
Figure 3:
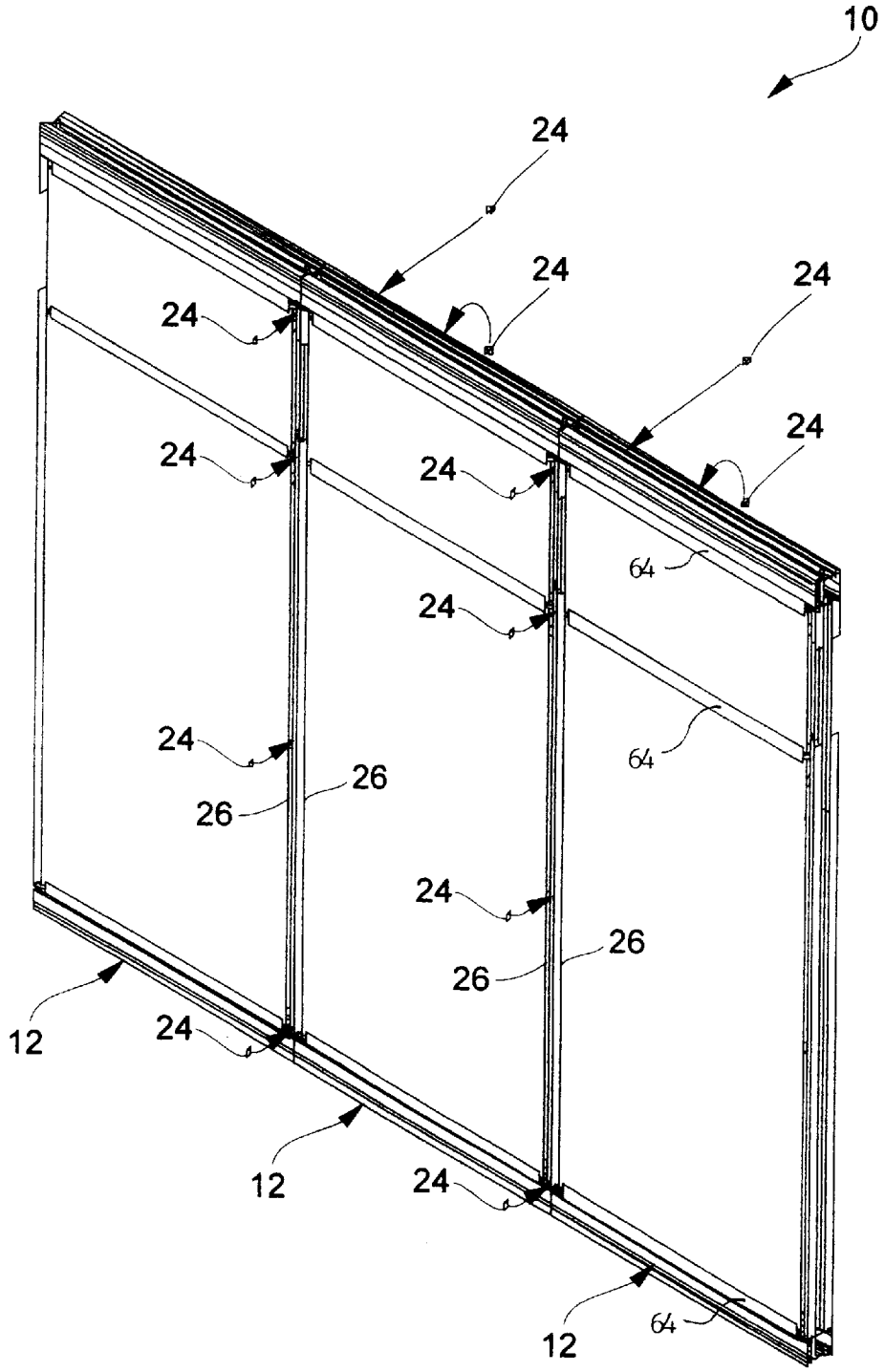
FIG. 3 is an isometric view of a modular partition system, constructed and operative according to the teachings of the present invention, showing three of the relocatable panel units of FIG. 1 during assembly.
Figure 4:
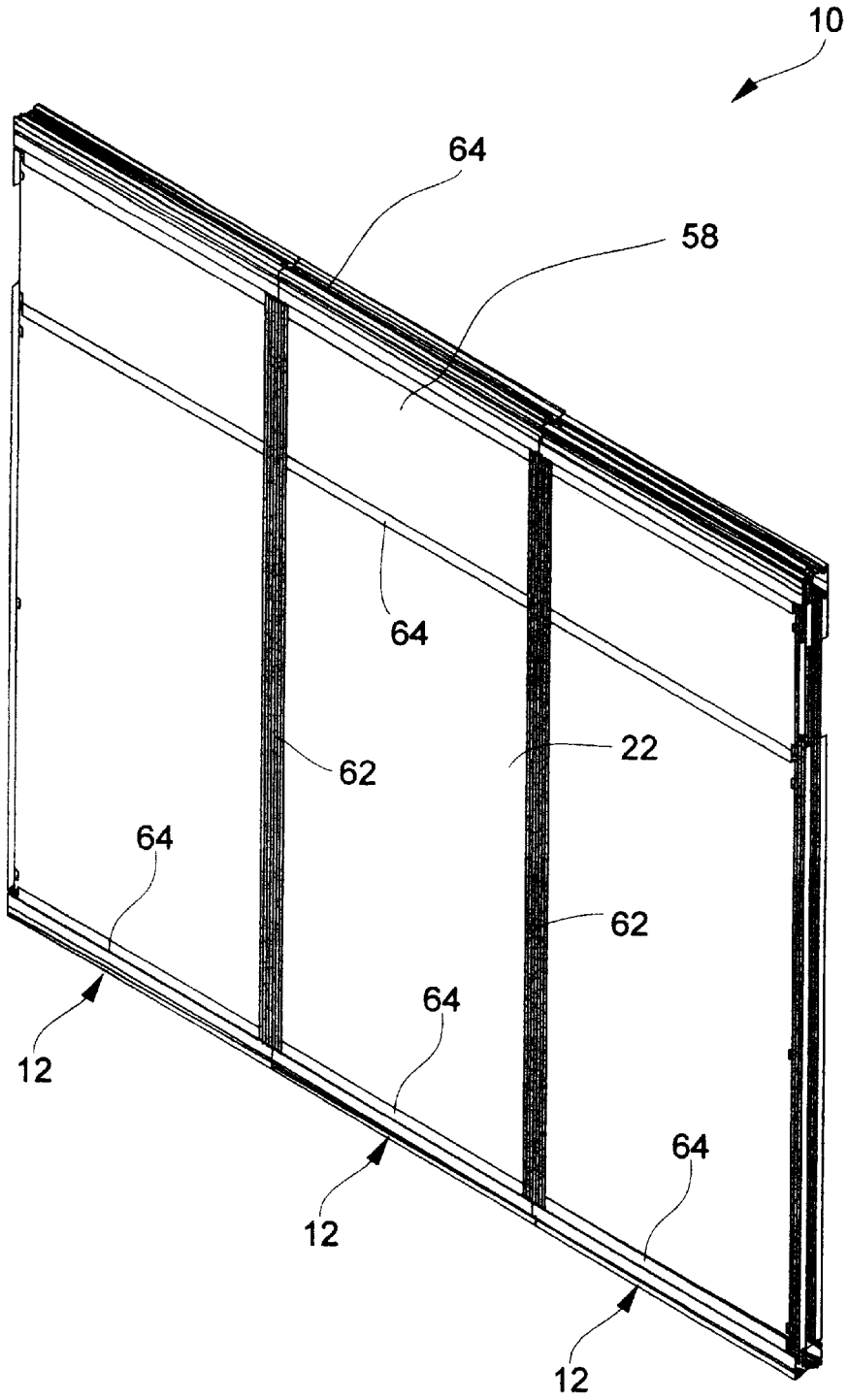
FIG. 4 is an isometric view of the modular partition system of FIG. 3 fully assembled.

The present invention is a modular partition system and a method for assembling such a system.

The principles and operation of partition systems and methods according to the present invention may be better understood with reference to the drawings and the accompanying description.

Referring now to the drawings, FIGS. 1–19 show all or part of a modular partition system, generally designated 10, constructed and operative according to the teachings of the present invention. Generally speaking, modular partition system 10 employs at least two relocatable panel units 12, each including a substantially rectangular frame formed from two substantially horizontal frame elements 14 and 16 and two substantially vertical frame elements 18 and 20 interconnected so as to define a substantially rectangular opening. Each panel unit 12 also includes at least one panel 22 mounted within the opening. At least one connector 24 rigidly connects adjacent substantially vertical frame elements 18 and 20 from different panel units 12, thereby combining them to form a partition.

It is a particular feature of most preferred embodiments of the present invention that substantially vertical frame elements 18 and 20 are configured to provide attachment portions 26 accessible from the front of the panel unit for receiving connectors 24. This allows connection of panel units 12 with panels 22 in place, thereby facilitating dissembly and reassembly of the partition without requiring taking apart of the individual panel unit 12.

This and other advantageous features of the modular partition system of the present invention will become clearer from the following description accompanying FIGS. 1–19. Features of the method of assembly according to the present invention and a template for use therein will be described particularly with reference to FIGS. 20 and 21A–21D.

Before turning to the structure in more detail, it should be noted that the present invention is not limited to any specific materials for either the structural elements or the panels. Typically, the materials of the horizontal and vertical elements will be extrudable materials or other materials suitable for continuous production processes. Examples of suitable materials include, but are not limited to, various metals and polymer materials. The panels may be made from any desired material or composite construction suitable for forming panels. Examples include, but are not limited to, plasterboard, wood, glass, plastics and other polymers, metal, and textiles supported by suitable structures.

Figure 5:
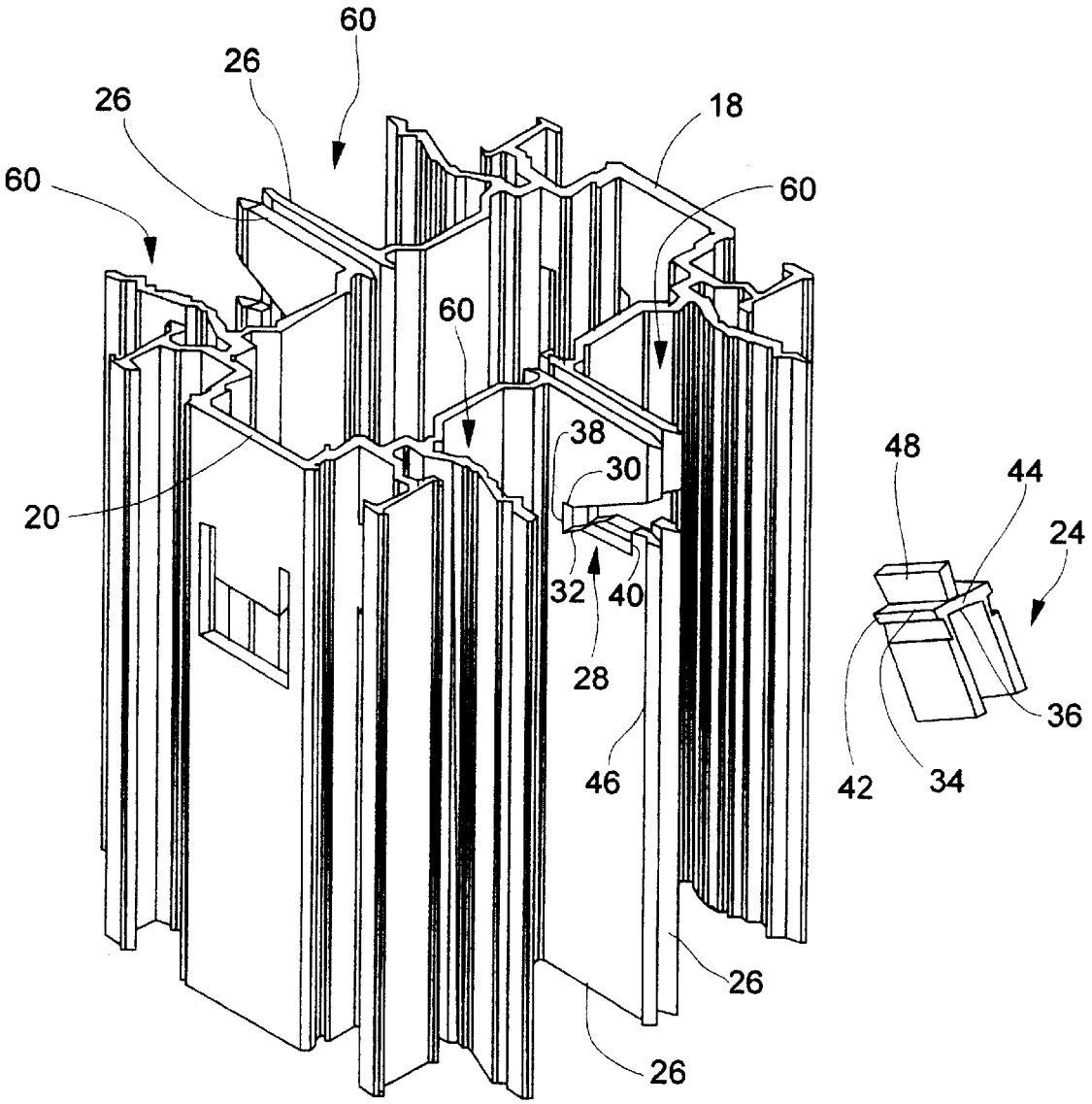
FIG. 5 is an isometric view of a preferred construction for connecting panel units in the modular partition system of FIG. 3 employing a connector bracket engaging profiled cut-outs in two vertical flanges.

Turning now to the features of modular partition system 10 in more detail, a preferred configuration of vertical frame elements 18 and 20 and connectors 24 are shown in FIG. 5. Here, attachment portions 26 are implemented as flanges deployed vertically and in a plane substantially perpendicular to a plane of the opening, preferably extending along a significant proportion of the height of both vertical frame elements on both sides of each element. Each connector 24 is implemented as a connector bracket configured for engaging two of the flanges.

Advantageously, connector brackets 24 may be configured to provide precision alignment of vertical elements 18 and 20 in one-, two-, or preferably three-dimensions. Thus, in the preferred implementation shown here, each connector bracket 24 engages through a twist-in motion within a profiled cut-out 28 formed in each flange 26. Parenthetically, at this point it should be noted that the words "cut-out" are used in this context as descriptive of the final form of the feature without implying any particular production process.

Figure 6A:
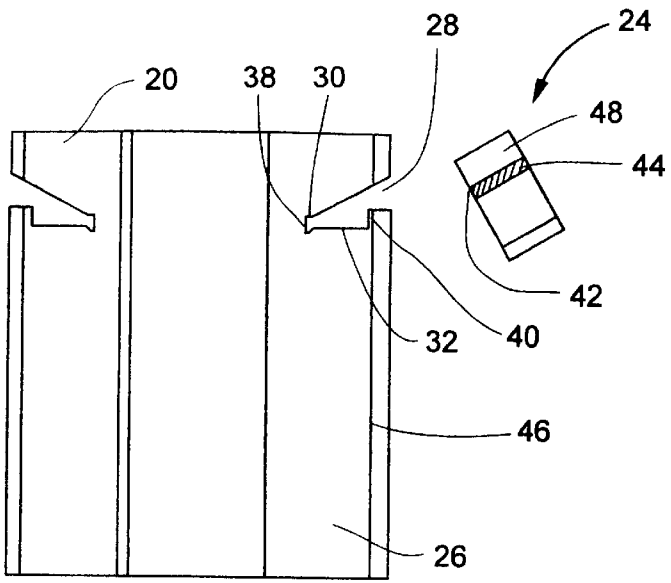
FIGS. 6A, 6B and 6C are side views showing successive stages of engagement of the connector bracket within the profiled cut-outs of FIG. 5.
Figure 6B:
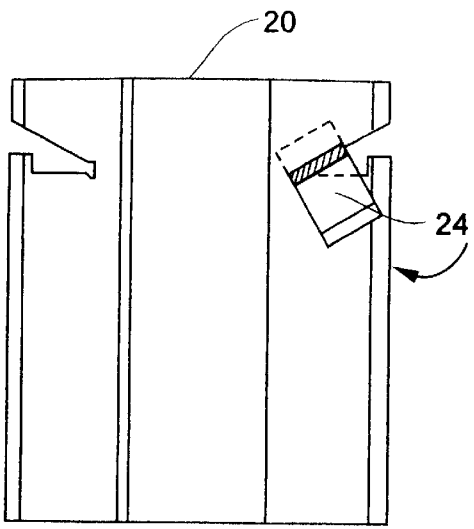

Each profiled cut-out 28 is configured to provide upper and lower abutment surfaces 30 and 32, respectively, positioned for abutting corresponding surfaces 34 and 36 of connector bracket 24. Similarly, each profiled cut-out 28 is configured to provide rear and front abutment surfaces 38 and 40, respectively, positioned for abutting corresponding surfaces 42 and 44 of connector bracket 24. The twist-in motion required to insert connector bracket 24 within cut-out 28 is represented by the sequence of FIGS. 6A–6C.

Figure 6C:
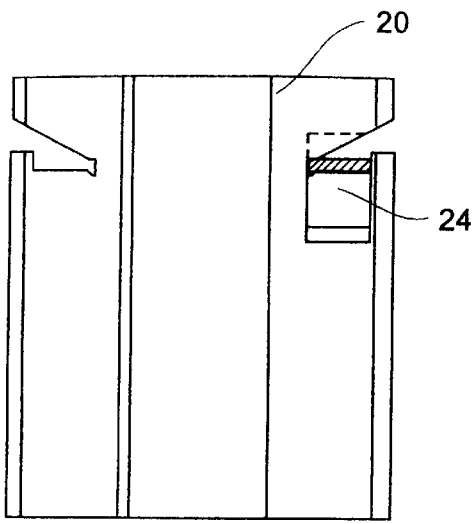
Figure 7:
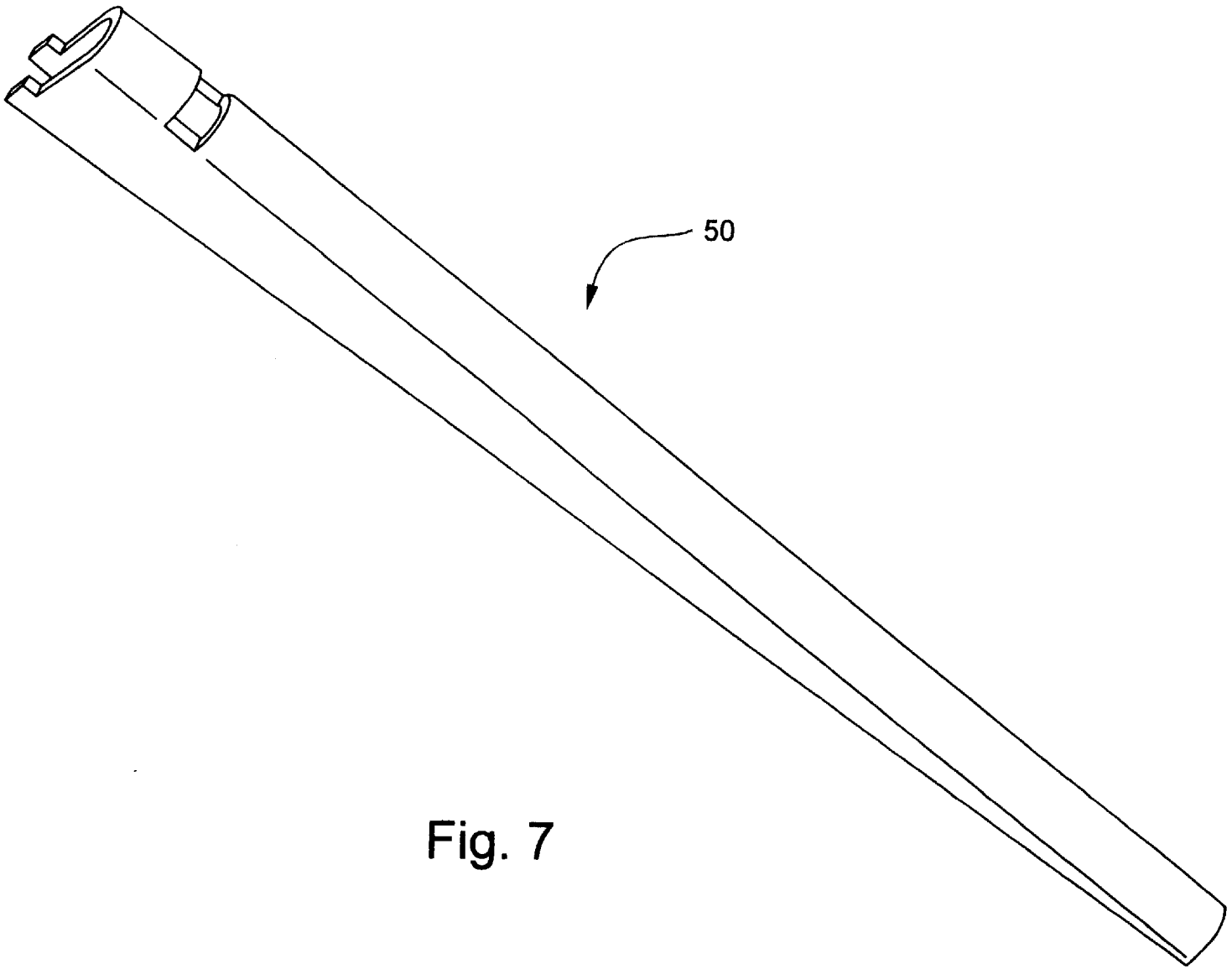
FIG. 7 is an isometric view of an alternative projecting connector bracket for supporting a partition accessory.
Figure 8A:
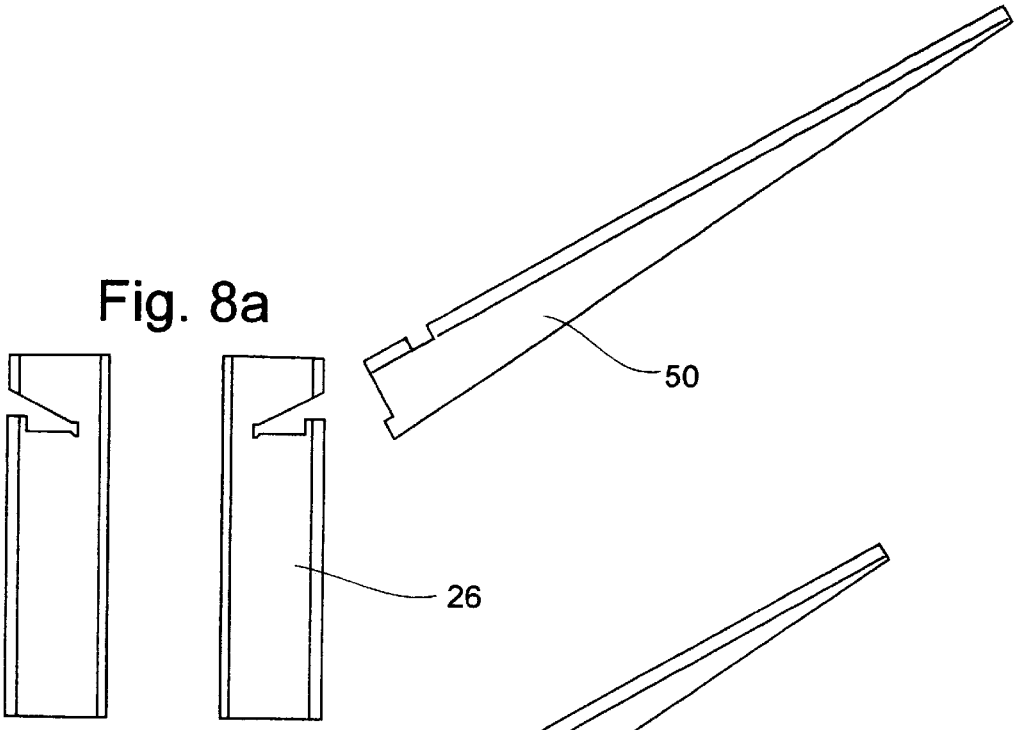
FIGS. 8A, 8B and 8C are side views showing successive stages of engagement of the alternative connector bracket of FIG. 7 within the profiled cut-outs of FIG. 5.
Figure 8B:
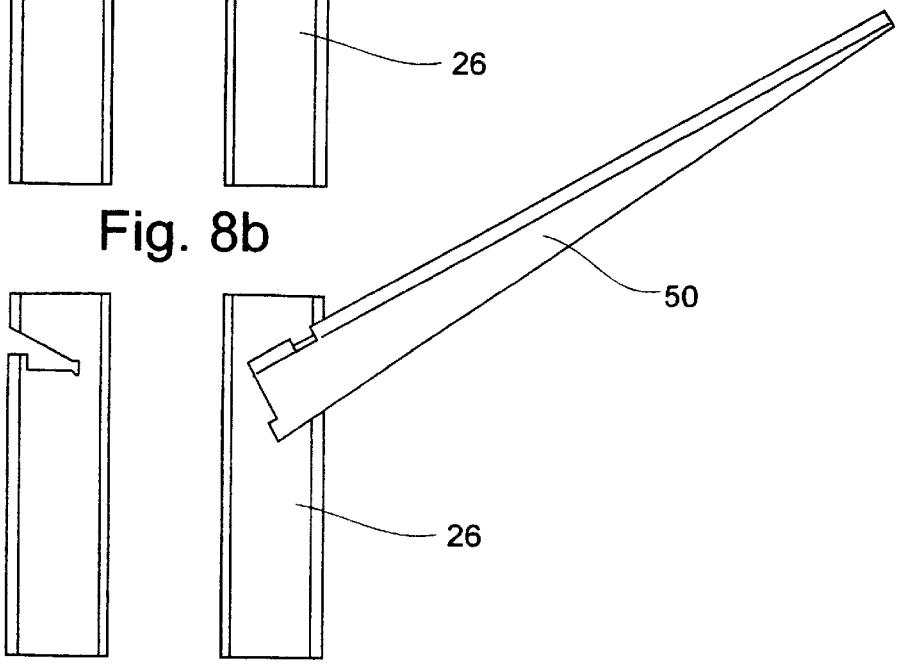
Figure 8C:
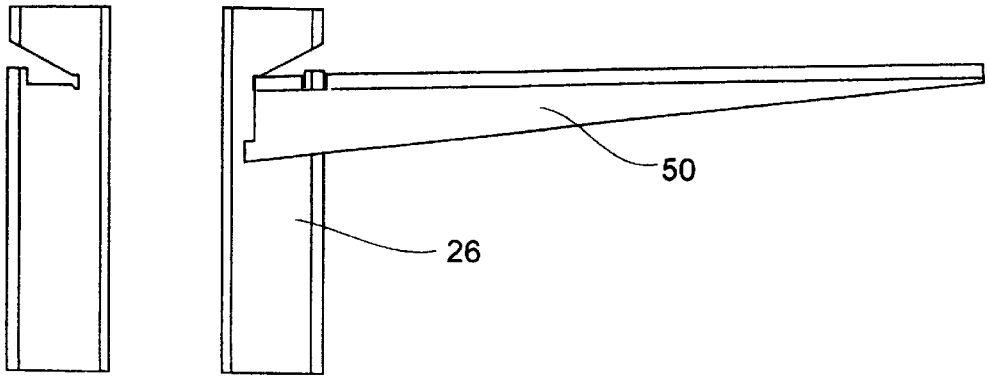
Figure 9:
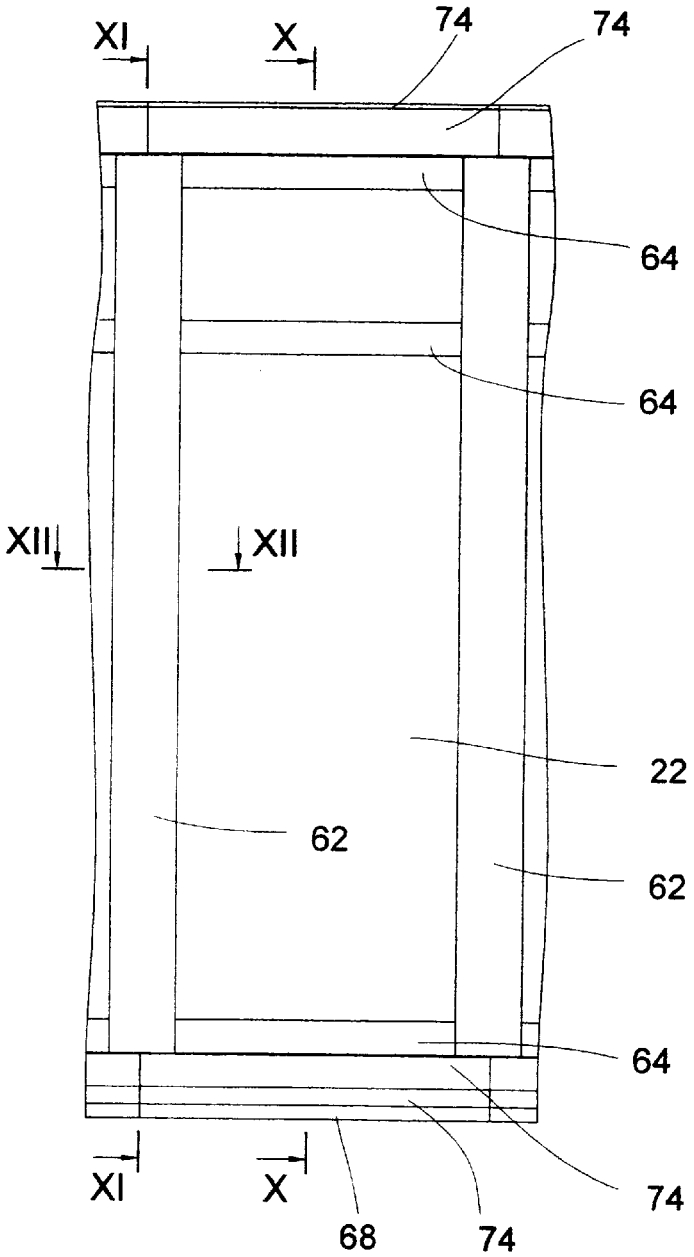
FIG. 9 is a front view of part of the modular partition system of FIG. 3.

It will readily be apparent that, in the engaged position of FIG. 6C, upper and lower abutment surfaces 30 and 32 abut corresponding surfaces 34 and 36 of connector bracket 24 so as to lock adjacent flanges 26 against relative vertical movement. At the same time, abutment of rear and front abutment surfaces 38 and 40 against surfaces 42 and 44 of connector bracket 24 lock the flanges against relative horizontal movement in a direction perpendicular to the plane of the partition. Since rear and front abutment surfaces 38 and 40 directly oppose each other and lower abutment surface 32 extends to a position almost opposite upper abutment surface 30, forces acting to misalign flanges 26 produce very small turning moments on connector bracket 24, thus being ineffective to produce the rotation required to release the locking effect. The locking effect is preferably further enhanced by the presence of a projecting lip 46 at or near the edge of flange 26 over which part of connector bracket 24 slides during insertion to give a click-in positive locking action.

A further preferred feature of connector bracket 24 is the provision of a spacer projection 48 for insertion between adjacent flanges 26 so as to produce a pre-defined clearance gap between the flanges. This clearance gap ensures that there is always sufficient clearance to remove or insert panel units between already standing panel units of an existing partition.

Turning now to FIGS. 7 and 8A–8C, it should be noted that the attachment structure described above readily lends itself to adaptation for mounting accessories on a partition. Thus, one or more of the connector brackets may be implemented as a projecting connector bracket 50 configured to project outwards from the partition system to support at least one partition accessory. The phrase "partition accessory" in this context is used to refer generically to any item which one may wish to support from a partition. Examples include, but are not limited to, shelves, tables, chairs, light fittings, computer equipment and decorations. It should be noted that the projecting portion of connector bracket 50 may take any of a large number of forms as is known in the art according to the intended application. Furthermore, two or more brackets of similar or distinct forms may be used together to support large, heavy, or load bearing partition accessories.

Turning now particularly to FIGS. 9–13, a range of further structural features of certain preferred implementations of modular partition system 10 will now be described. Firstly, as mentioned earlier, systems for use as floor-to-ceiling partitions must accommodate a significant range of height dimensions. This is preferably achieved by providing panel units 12 with a telescopic structure defining an upper panel opening. Thus, each panel unit 12 preferably includes two telescopic extension elements 52, each mounted with respect to one of substantially vertical frame elements 18, 20 so as to be extendible vertically above the upper of substantially horizontal frame elements 16. Telescopic extension elements 52 may best be seen in FIGS. 1, 11A, 12 and 13. A fastening means 54 (see FIG. 13) is provided for fastening telescopic extension elements 52 in a desired position relative to frame elements 18 and 20. Fastening means 54 may be implemented as any type of fastening which readily permits raising of extension elements 52 to a required height and fastening against subsequent movement in at least a downward direction. In the particular example illustrated here, fastening means 54 includes a key element 55 shaped to be selectively insertable through and lockable by rotation within profiled keyhole slots 57 spaced along the height dimension of extension element 52. Alternative implementations may employ a simple mechanical fastening such as a ratchet mechanism or a lock-pin engagable in a row of transverse holes. To complete the upper panel opening, a supplementary substantially horizontal frame element 56 is provided. This connects between the two telescopic extension elements 52 such that supplementary frame element 56, telescopic extension elements 52 and frame element 16 together define a secondary substantially rectangular opening for receiving an upper panel.

Figure 19C:
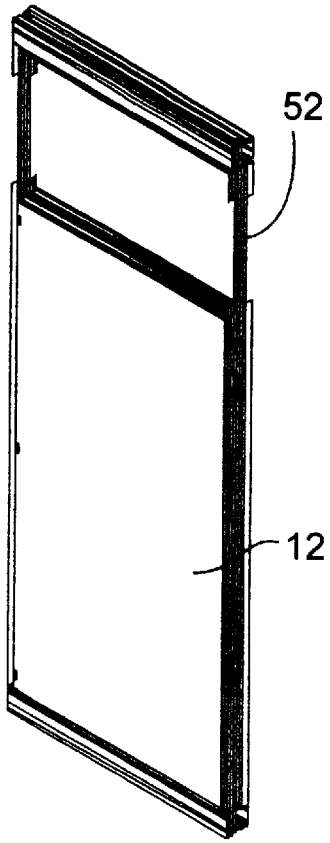
FIGS. 19A–19C show three positions of a telescopic adjustment mechanism of a preferred implementation of the panel unit of FIG. 1.
Figure 19B:
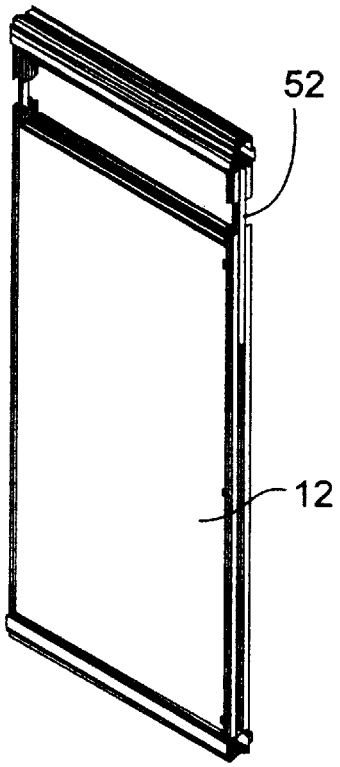
Figure 19A:
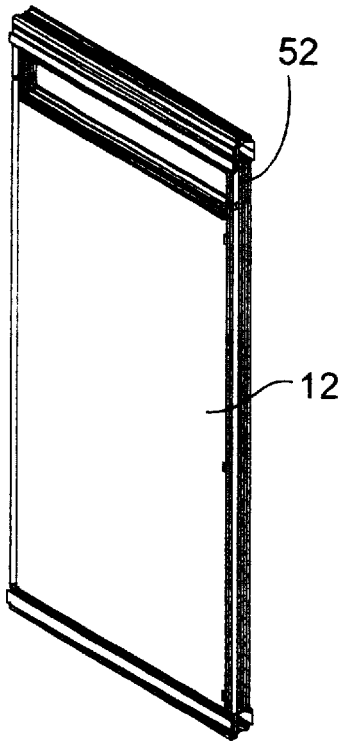
Figure 20:
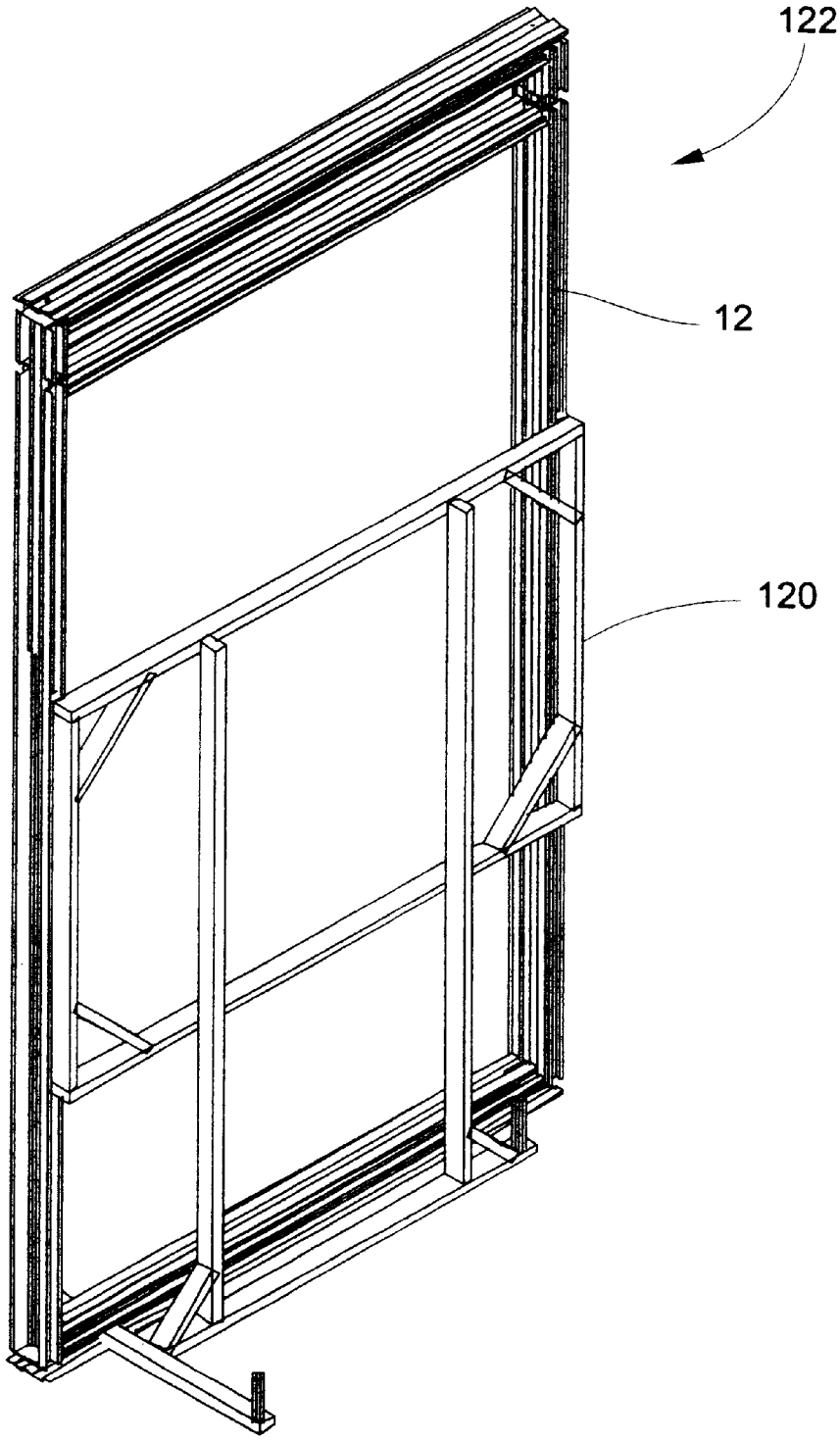
FIG. 20 shows a rigid template used in assembling a modular partition system according to the teachings of the present invention.

Clearly, the height of the upper panel opening varies according to the position of telescopic extension elements 52 as may be seen by comparing FIGS. 19A–19C. An upper panel 58 (see FIG. 2) must therefore be sized appropriately for each floor-to-ceiling height. However, it will be noted that all other components of the system are of standard design, thus allowing near-complete installation with standard mass-produced components and without requiring any prior measurement of the site to be fitted. Depending on the panel material and the preference of the user, upper panels 58 are then either cut on-site or produced off-site according to measurements taken during the primary installation.

A further set of features of certain preferred implementations of modular partition system 10 are designed to facilitate installation of electrical wiring and the like without requiring dissembly or detaching of panel units 12. To this end, each substantially vertical frame element 18, 20 is formed with at least one and typically two vertical channels 60 (see FIGS. 5 and 12) for housing electrical wiring. Channels 60 are configured to be accessible from the front or back of panel unit 12 without removal of panels 22. At least one cover element 62 is configured for attachment to substantially vertical frame elements 18, 20 so as to conceal channels 60 and their contents from view (see FIG. 4). Preferably, each cover element 62 is configured to clip to both adjacent frame elements 18 and 20, thereby covering the entire width of the region in which panel units 12 are attached.

Parenthetically, it should be noted that covers 62 also preferably overlap the side edges of panels 22 and upper panels 58. By concealing the edges of the panels from view, high quality aesthetic finishing of the panel edges is rendered unnecessary. An arrangement of panel retaining clips to be described below is also concealed from view by covers 62. An equivalent function is served by horizontally deployed covers 64 seen in FIGS. 3 and 10B–10D.

Returning now to the subject of electrical wiring, horizontal channels are preferably provided within adjustable plinth regions at the top and/or base of the panel units as will now be described with reference to FIGS. 10A–11C.

Figure 11B:
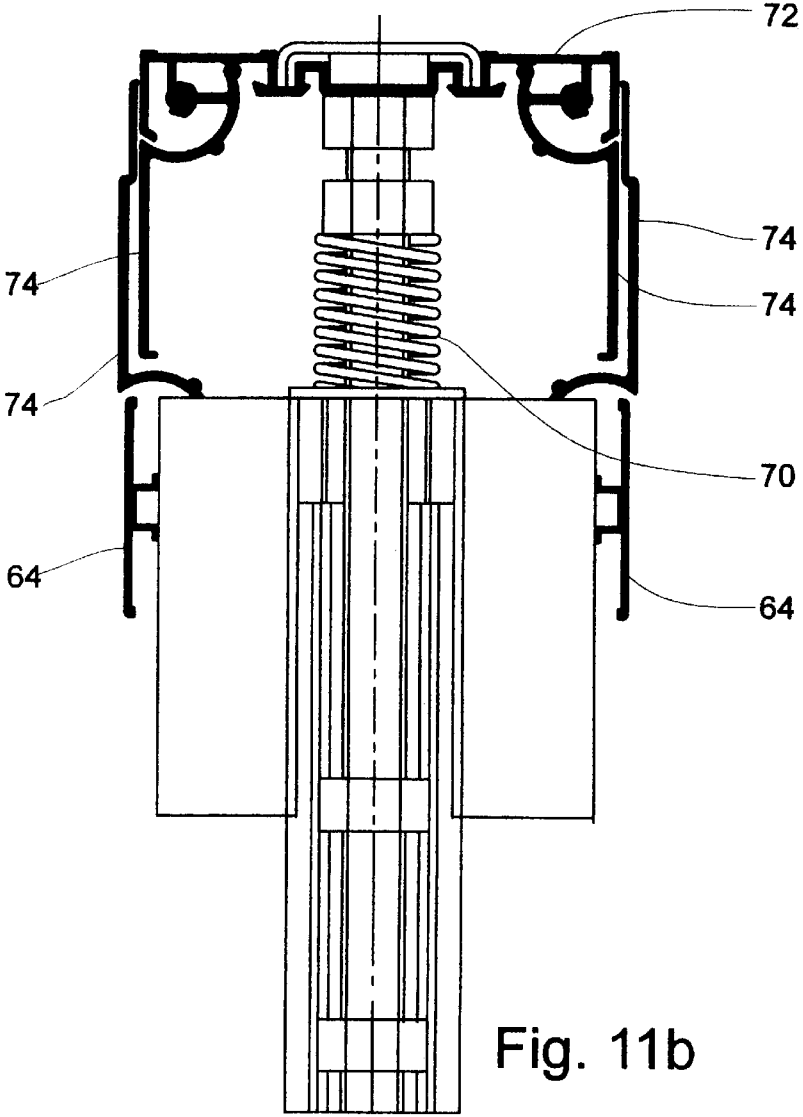
FIGS. 11B and 11C are enlarged views of regions of FIG. 11A designated B and C, respectively.
Figure 11A:
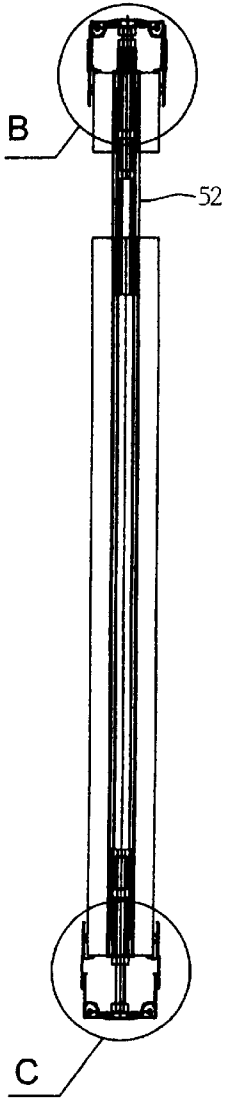
FIG. 11A is a cross-sectional view taken along the line XI—XI of FIG. 9.
Figure 11C:
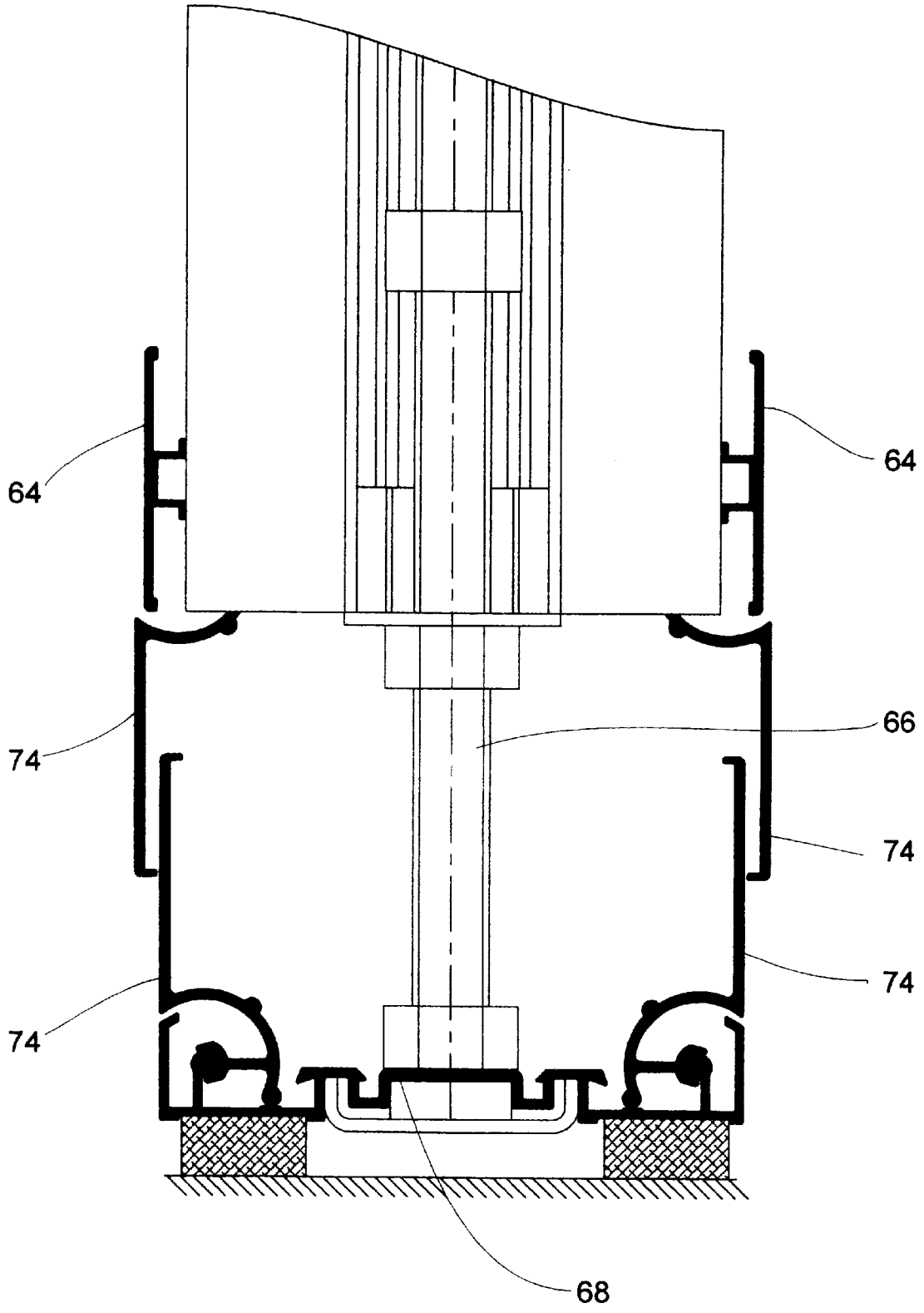
Figure 12:
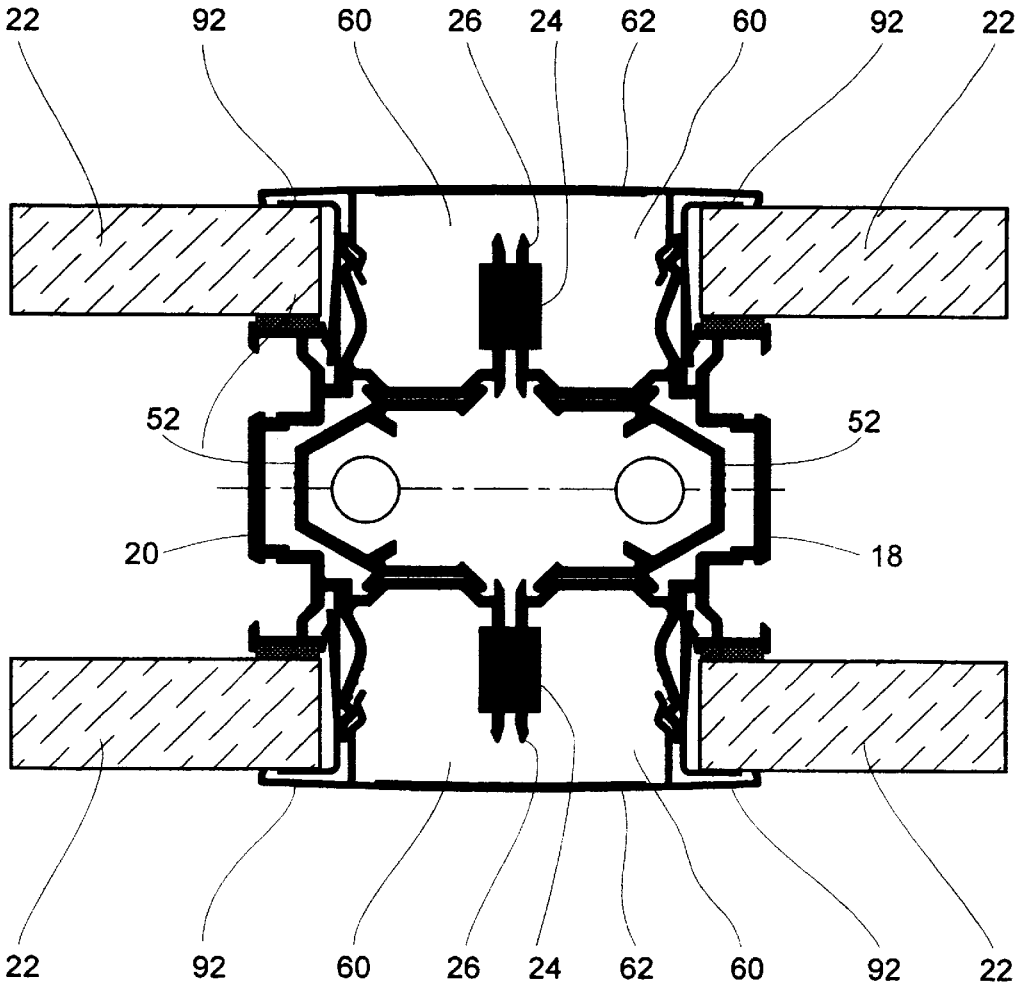
FIG. 12 is a cross-sectional view taken along the line XII—XII of FIG. 9.
Figure 13:
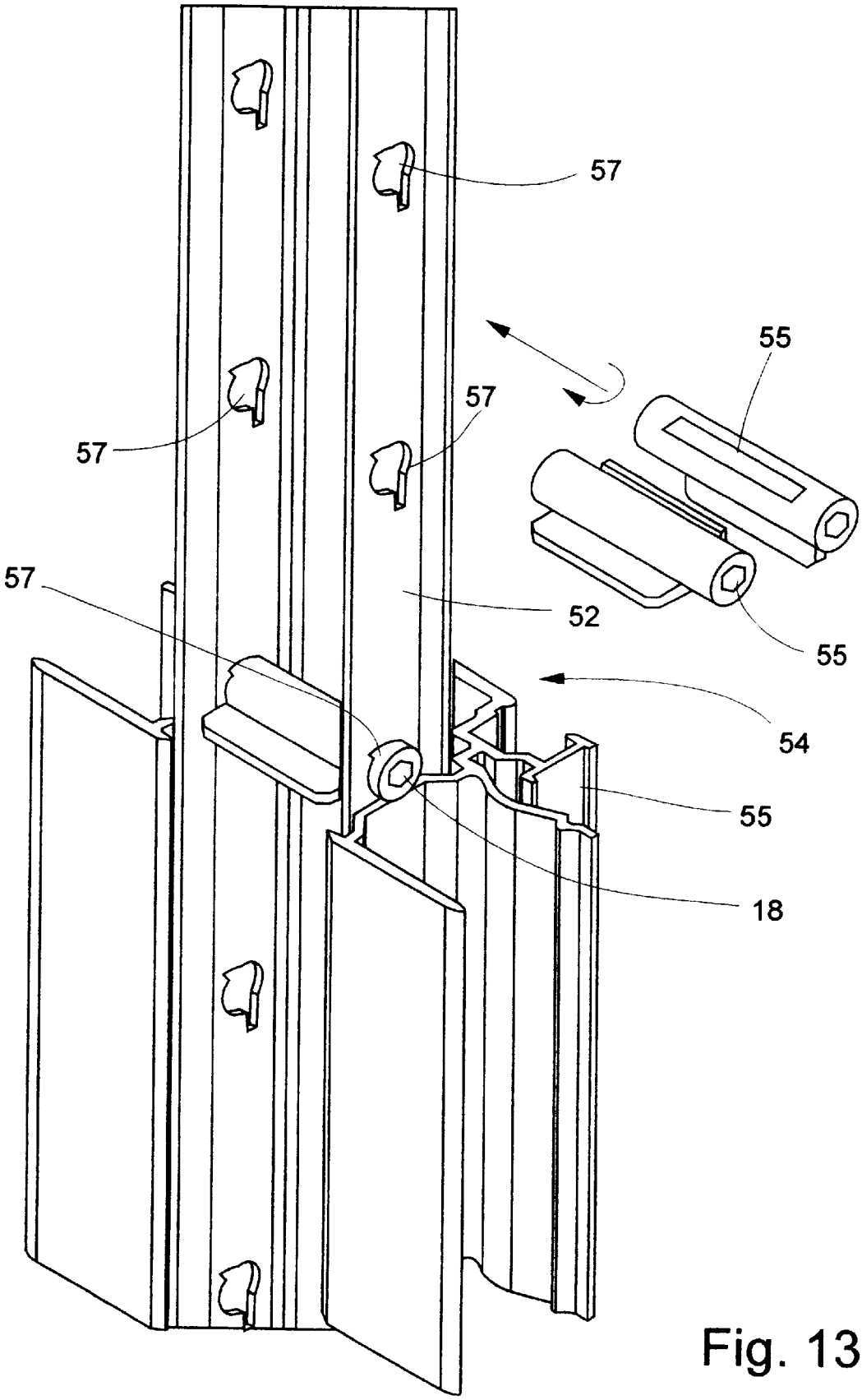
FIG. 13 is a detailed isometric view of a telescopic structure of the panel unit of FIG. 1 showing a fastening means.

Firstly, referring to FIGS. 11A–11C, each substantially vertical frame element 18, 20 preferably terminates at its bottom end in an adjustable foot 66 which bears upon a base strip 68 (FIG. 11C). Similarly, each substantially vertical frame element 18, 20 or associated telescopic extension element 52 preferably terminates at its top end in a spring-biased adjustable upper stop 70 which bears against a top strip 72 (FIG. 11B). The design of adjustable feet 66 and stops 68 are typically structurally similar to those known in the art, although their mode of use during assembly of the partition preferably differs considerably from the standard procedure as will be discussed below in the context of the method of the present invention. The range of adjustment of stops 68 is preferably chosen to be at least the step between lockable positions of extension elements 52 so that these two features together accommodate a continuous range of variation in ceiling heights.

The variable gaps between lower substantially horizontal frame element 14 and base strip 68, and between supplementary substantially horizontal frame element 56 and top strip 72, are preferably closed by pairs of overlapping plinth elements 74 mounted on respective elements either side of each gap. The degree of overlap between plinth elements 74 then varies according to the state of the adjustable elements 66 and 70.

It is a particular feature of certain preferred implementations of the present invention that at least one, and preferably both, of the overlapping plinth elements 74 are hingedly mounted such that plinth elements 74 can be swung outwards. This provides convenient access to a horizontally extending internal volume along the bottom and/or top of each panel unit 12. The interconnection of these horizontally extending volumes with vertical channels 60 provide high accessibility for routing and re-routing of wiring and the like along the partitions of the present invention to any required location.

Figure 10A:
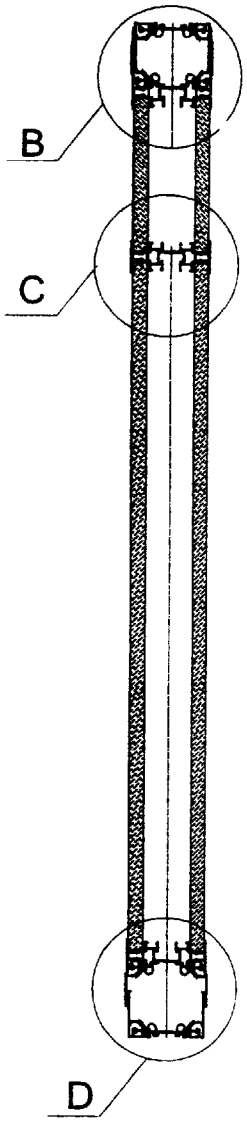
FIG. 10A is a cross-sectional view taken along the line X—X of FIG. 9.
Figure 10B:
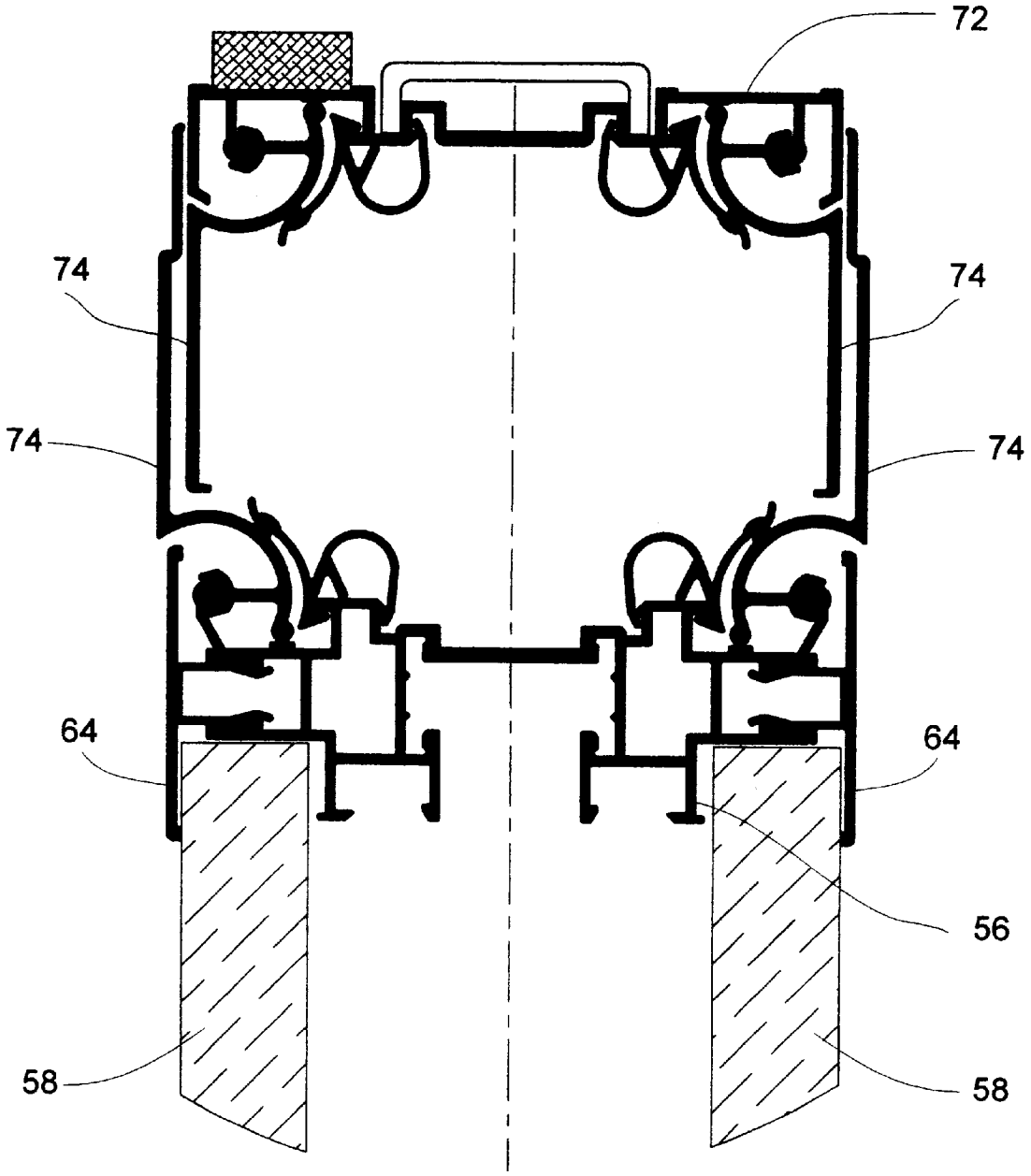
FIGS. 10B, 10C and 10D are enlarged views of regions of FIG. 10A designated B, C and D, respectively.
Figure 10C:
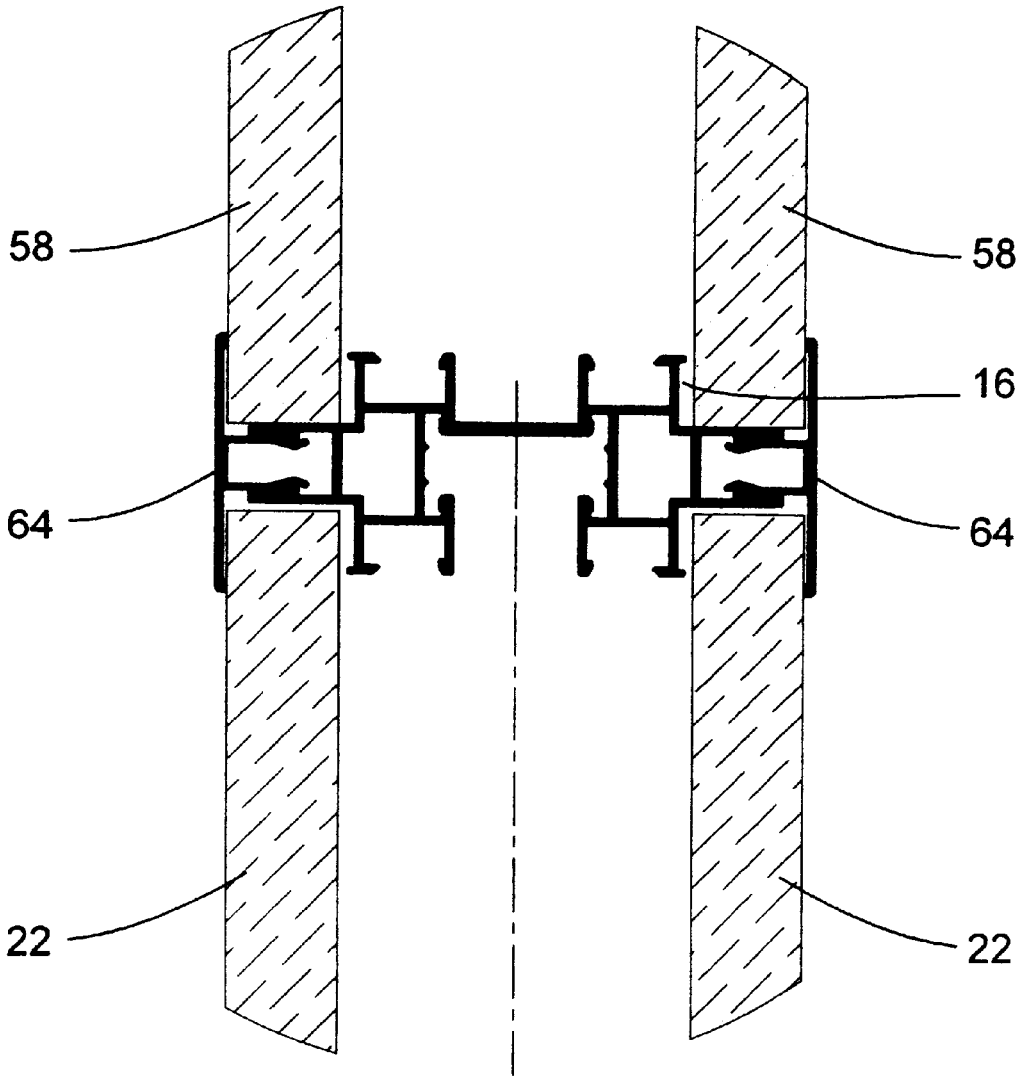
Figure 10D:
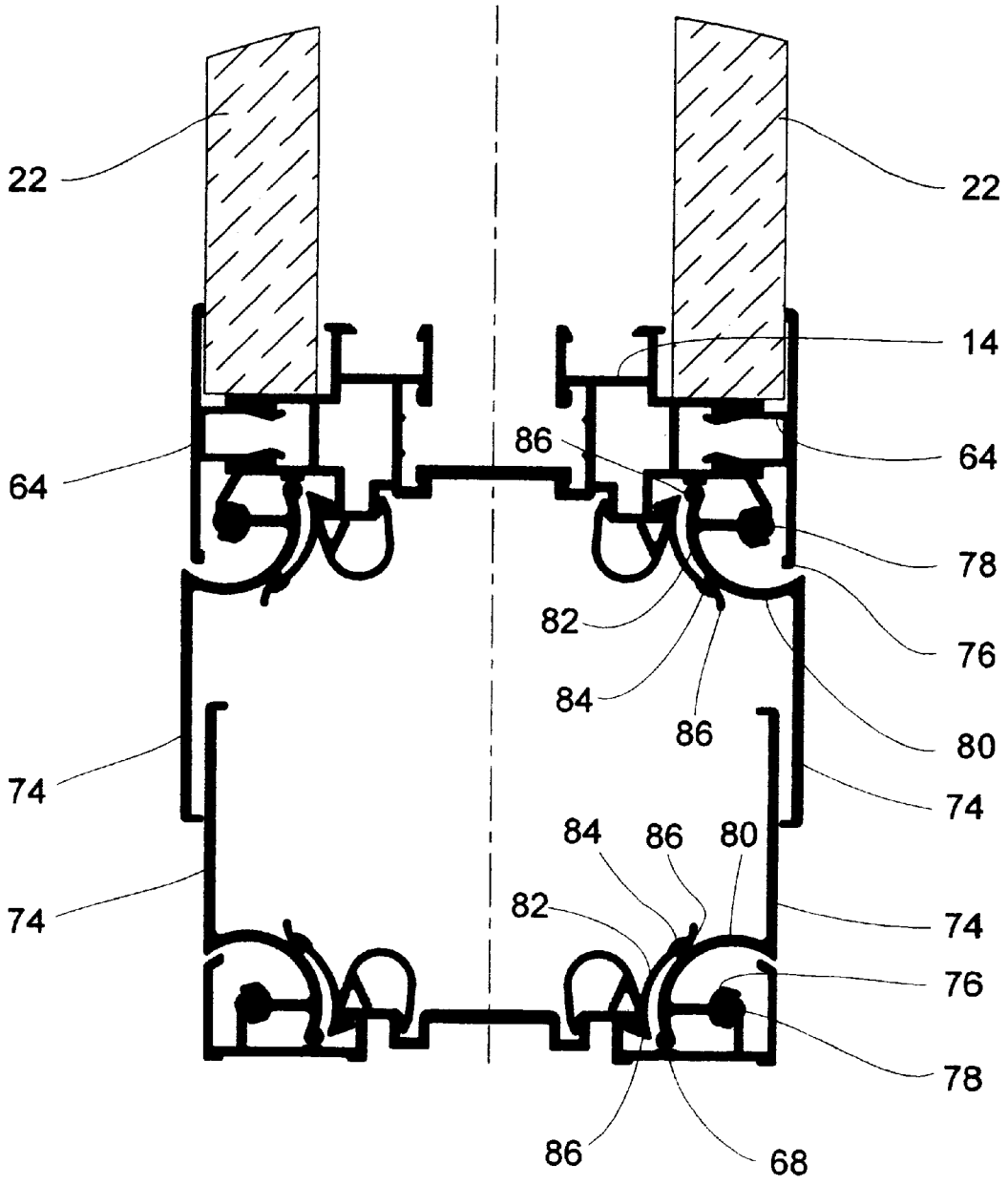
Figure 10E:
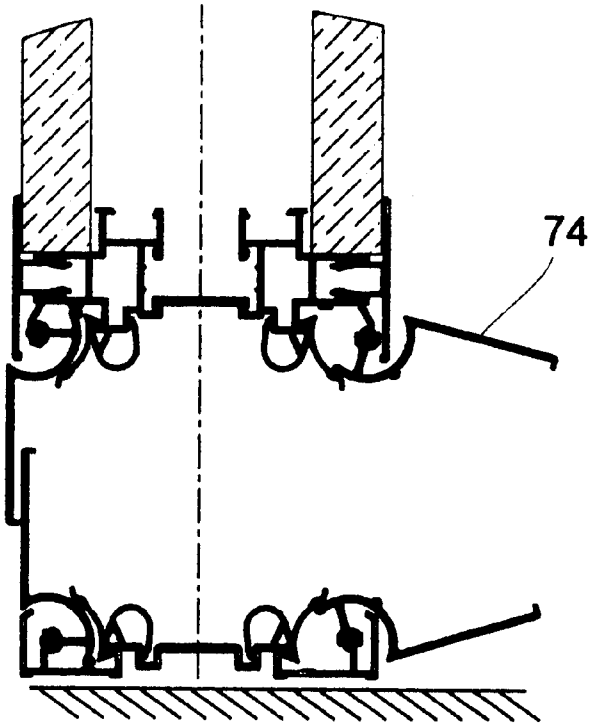
FIGS. 10E and 10F are views similar to FIG. 10D showing operation of hingedly mounted overlapping plinth elements to provide access to an internal volume.
Figure 10F:
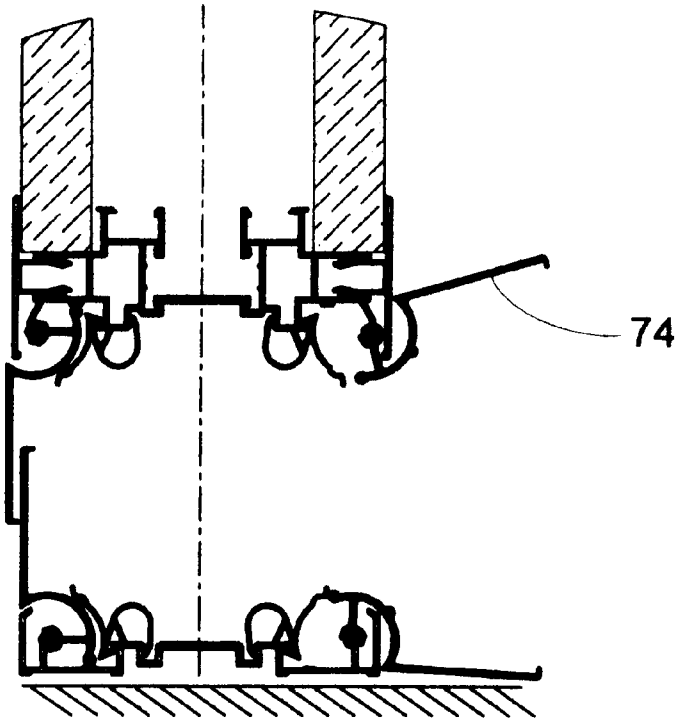

By way of example, FIGS. 10D–10F show the structure and operation of one possible form of hinged mounting of plinth elements 74. In this case, a readily detachable hinge structure is used in which a cylindrical socket 76 of plinth element 74 engages the outside of a hinge pin 78 while a substantially cylindrical outer surface 80 of the hinge portion of plinth element 74 is biased towards hinge pin 78 by a spring element 82. Spring element 82 has a recess 84 for lightly engaging small projections 86 on outer surface 80. A first of projections 86 is configured to engage recess 84 to provide "click-in" retention of the plinth element in the closed position of FIGS. 10B and 10D. The second projection 86 is configured to engage recess 84 when the plinth elements are swung outwards to the position shown in FIG. 10E, thereby defining an open position. When the plinth element is rotated further, outer surface 80 clears spring element 82, allowing easy removal and insertion of the plinth element as shown in FIG. 10F.

Figure 14:
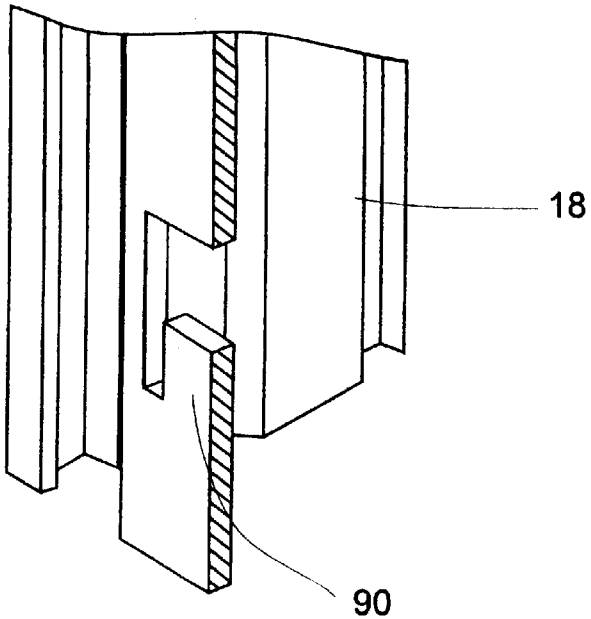
FIG. 14 is a partially cut-away isometric view of a preferred form of attachment between horizontal and vertical frame elements of the panel unit of FIG. 1.
Figure 14:
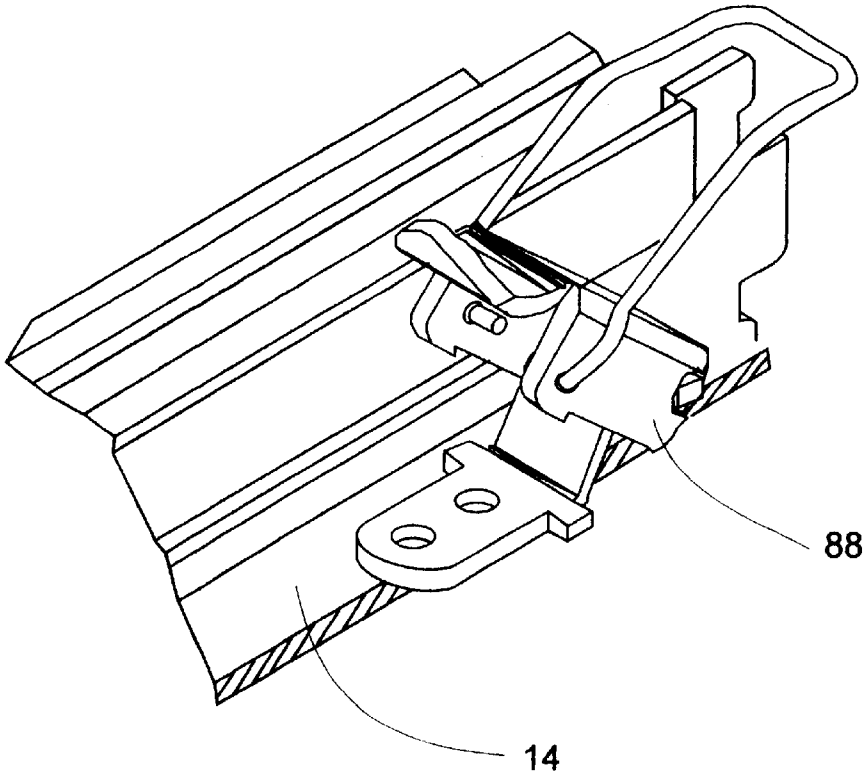
Figure 15:
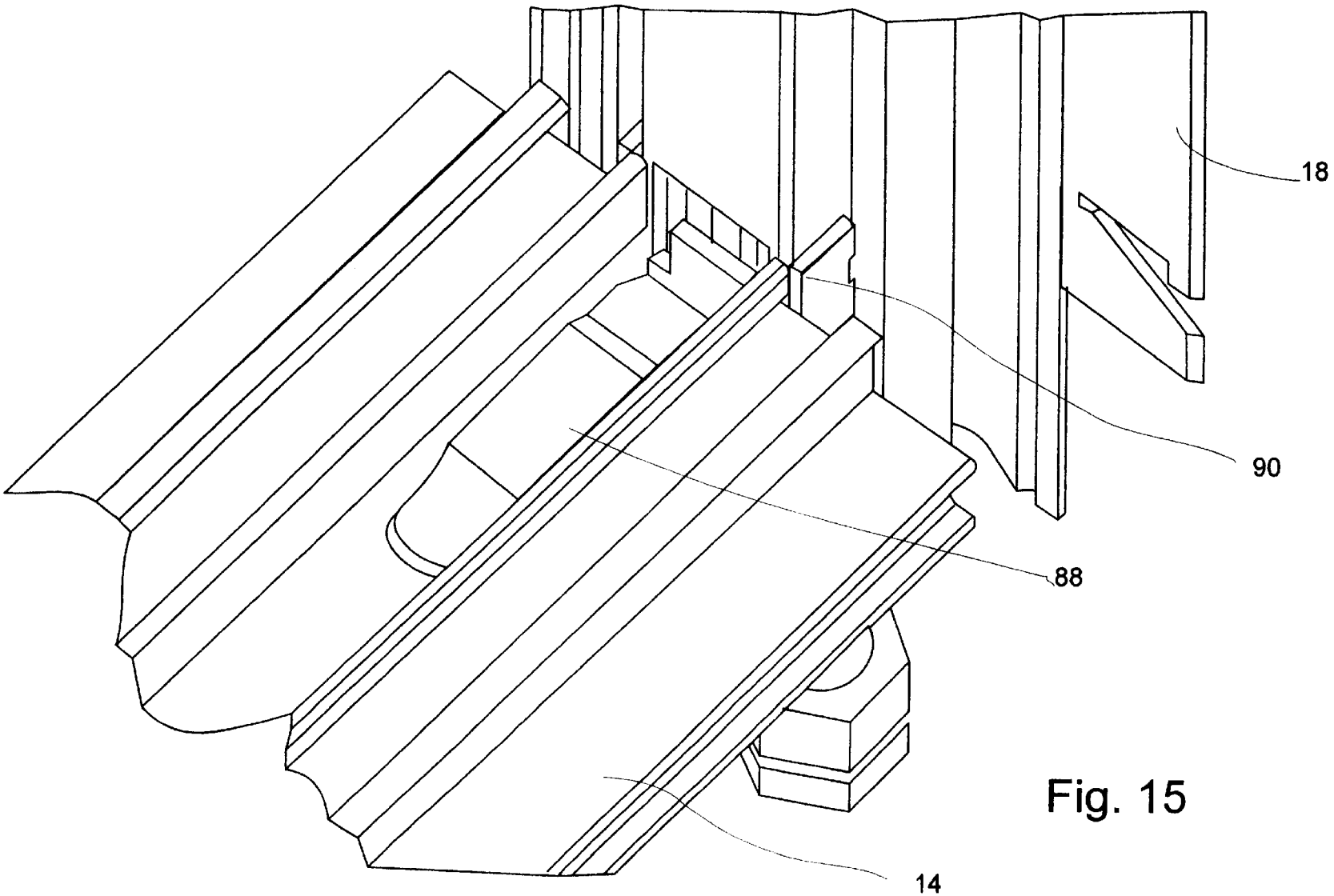
FIG. 15 is an isometric view of a horizontal and a vertical frame element attached by the attachment of FIG. 14.
Figure 17B:
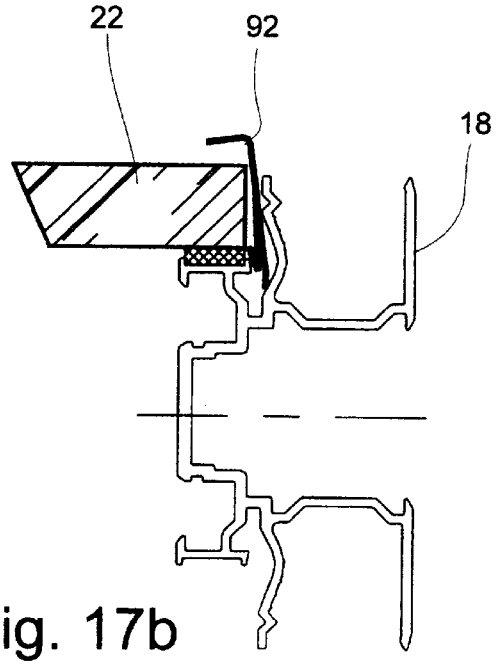
FIGS. 17A–17D are sequential horizontal cross-sectional views at successive stages of insertion of the panel clip of FIG. 16A.
Figure 17A:
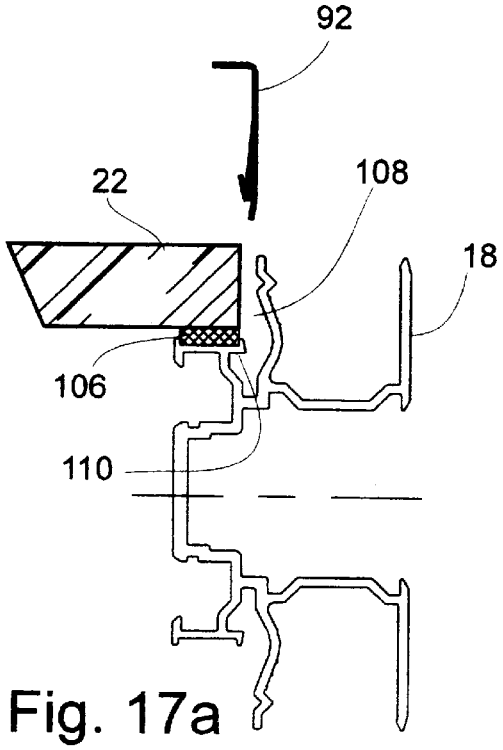
Figure 17D:
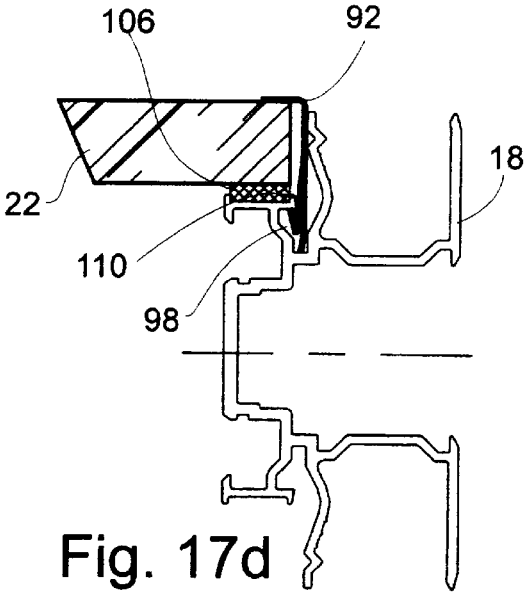
Figure 17C:
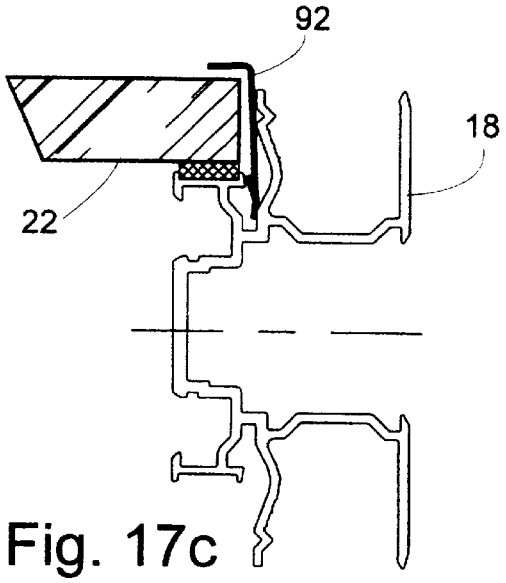

Turning now briefly to FIGS. 14 and 15, it will be noted that the connection between the various horizontal and vertical frame elements within each panel unit 12 may be achieved by any conventional form of attachment. Preferably, a latch-on clamp design is used through which the elements may rapidly be locked together with a minimum number of operations to be performed during installation. In the example illustrated here, a clamping loop of a latch-on clamp 88 attached to a horizontal frame element clamps onto a tongue 90 formed in a vertical frame element. As will be explained below in the context of the method of installation of the present invention, the frame connections of panel unit 12 preferably permit a certain degree of angular movement.

Turning now to FIGS. 16–18, a preferred arrangement of clips for retaining panels 22 and 58 in position will be described. Thus, FIGS. 16A–16D show a preferred form of a panel clip 92 for retaining a panel within the corresponding opening. Each panel clip 92 includes a substantially sheet-like insertable tab 94 with a resiliently biased tongue 96 resiliently biased to an out-of-plane position. Tongue 96 features a barbed projection 98. A clamping tab 100, attached to, or integrally formed with, insertable tab 94, projects laterally from the insertable tab for abutting a front surface of the panel. Preferably, an opening 102 is provided through panel clip 92 adjacent to the attachment of clamping tab 100 to insertable tab 94. Opening 102 is configured to allow insertion of a tool for removal of the panel clip. Tongue 96 preferably also features a hole 104 to allow a tool to latch onto the tongue.

FIGS. 17A–17D illustrate the insertion of panel clips 92 to retain a panel, in this case panel 22, against a vertical frame element, in this case substantially vertical frame element 18. Parenthetically, it should be appreciated at this point that the panel may be made from a wide variety of types and thicknesses of material. Correct seating of the panel is achieved by use of resilient pads or strips 106 of appropriate thickness mounted between frame element 18 and panel 22.

The vertical frame element as shown here is formed with a channel 108 extending along the edge of the panel opening. Channel 108 is shaped to provide a ridge 110 over which tongue 96 rides during insertion and behind which barbed projection 98 becomes lodged in the fully inserted position of FIG. 17D. Once fully inserted, clips 92 cannot be removed by direct outward force without applying force sufficient to destroy the clips. As a result, clips 92 provide very effective retention for even the heaviest of panels.

Figure 18B:
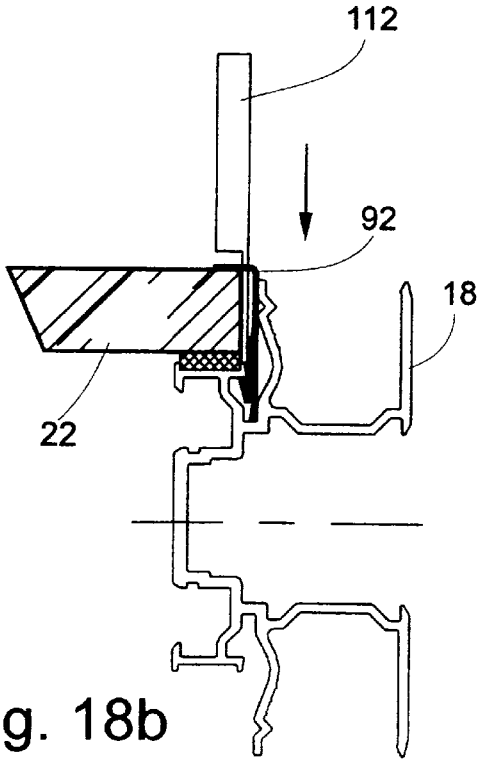
FIGS. 18A–18D are sequential horizontal cross-sectional views at successive stages of removal of the panel clip of FIG. 16A.
Figure 18A:
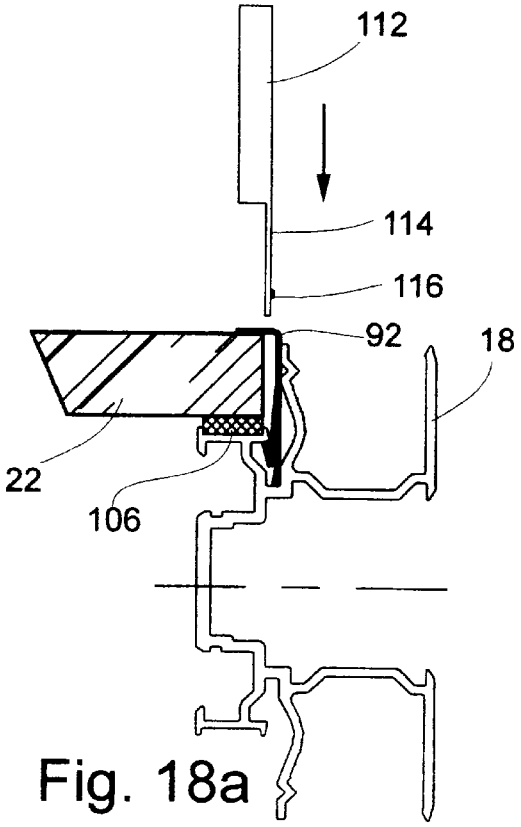
Figure 18D:
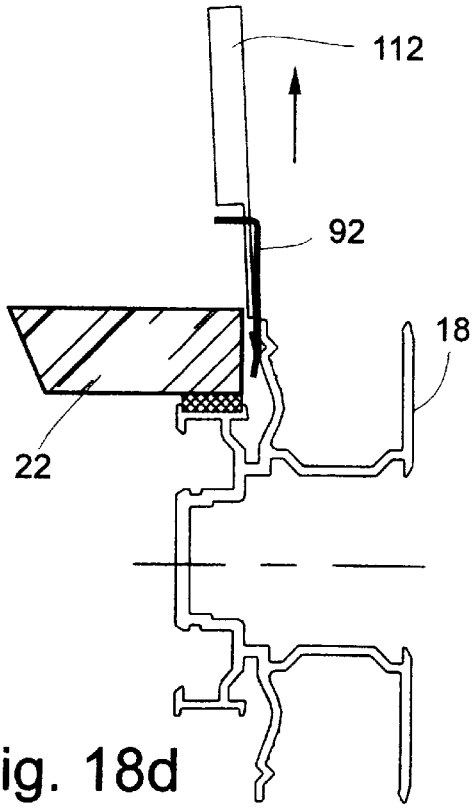
Figure 18C:
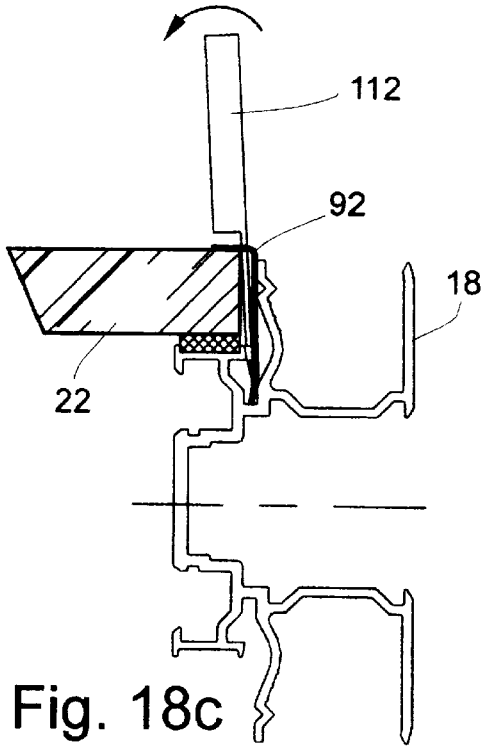

For removal of the clips, a clip-removing tool 112 is preferably provided, as shown in FIGS. 18A–18D. Tool 112 features an elongated blade 114 configured for insertion through opening 102 in clip 92. Near the extremity of blade 114 is a lateral projection 116 for engaging within hole 104. Once blade 114 is inserted and projection 116 has engaged hole 104, a levering motion of tool 112 as shown in FIG. 18C depresses tongue 96 so that barbed projection 98 clears ridge 110. Clip 92 can then be removed by withdrawing tool 112 as shown in FIG. 18D.

Finally, turning to FIGS. 20 and 21A–21D, a template structure and method for assembly of partitions according to the present invention will now be described. As mentioned earlier, conventional techniques for deploying partitions of all kinds typically require individual leveling/alignment for each element deployed. For modular partitions, one might expect that leveling of a first modular unit would be sufficient to ensure that adjacent units would also be level. In practice, however, units would need to be very massive and rigid in order to effectively maintain alignment from one unit to the next. Since the general trend in the art is towards lightweight, relatively non-rigid structures, repeated leveling procedures are generally required.

To address this problem, there is preferably provided a rigid template 120. As mentioned earlier, each panel unit 12 is preferably formed with a certain degree of angular flexibility at its frame joints. Rigid template 120 is configured to temporarily engage at least one panel unit 12, thereby forming a braced panel unit, generally designated 122, with well defined rectangular geometry. The braced panel units are sufficiently rigid to maintain alignment from one to the next during assembly. Once aligned, the adjustable base and top sections of the panel unit are readily adjusted to conform to the floor and ceiling, thereby fixing the alignment of the frame elements. The rigid template can then be removed without affecting the alignment already achieved.

Rigid template 120 must be configured to engage a panel unit 12 firmly and to impart well defined rectangular symmetry to the unit sufficient to transfer alignment from one vertical frame element to the next. This is typically achieved by complementary structures such as pins of template 120 configured to engage sockets in vertical frame elements 18, 20. Preferably, this engagement is achieved in a manner not obstructed by panels 22. Beyond these requirements and preferences, details of the structure of rigid template 120 are generally not critical. Template 120 is shown here schematically as a rectangular frame with corner braces, although in practice, alternative forms such as frames with extended diagonal elements or solid sheet structures may perform equally well or better. Optionally, template 120 may form part of an adjustable stand as shown to facilitate positioning of the panel unit for connection. Additionally, or alternatively, template 120 may be part of a cart-like wheeled structure to facilitate transfer of the panel unit between locations during moving of the partition from one position to another.

Parenthetically, it will be noted that there is a particular synergy between the use of template 120 and the form of connection between panel units 12 employing cut-outs 28 and connector brackets 24. The precise alignment and parallel spacing ensured by the connection described is ideally suited to providing precise alignment between adjacent panel units 12.

Figure 21A:
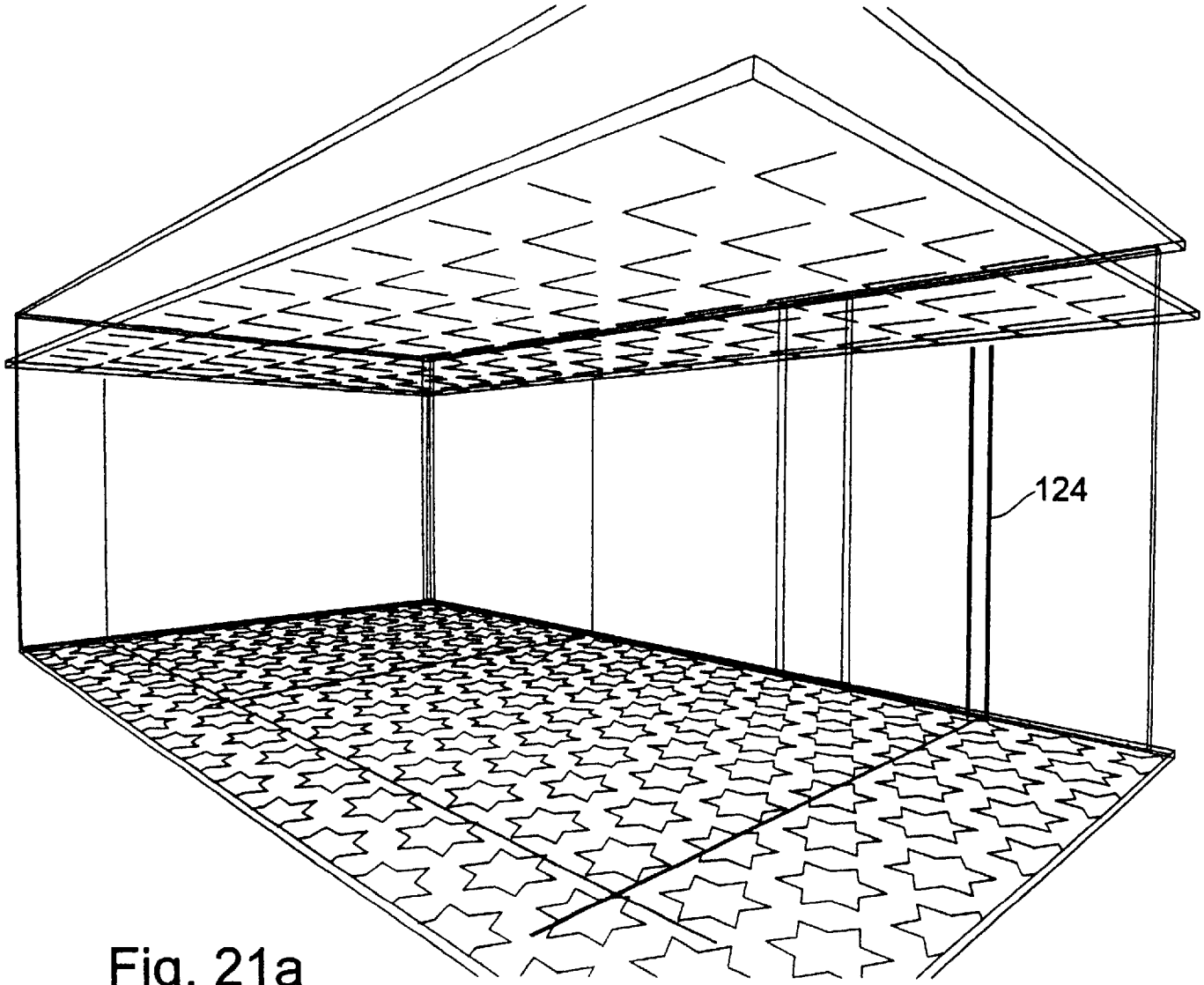
FIGS. 21A–21D are perspective views of stages during the assembly of a modular partition system according to the teachings of the present invention.
Figure 21B:
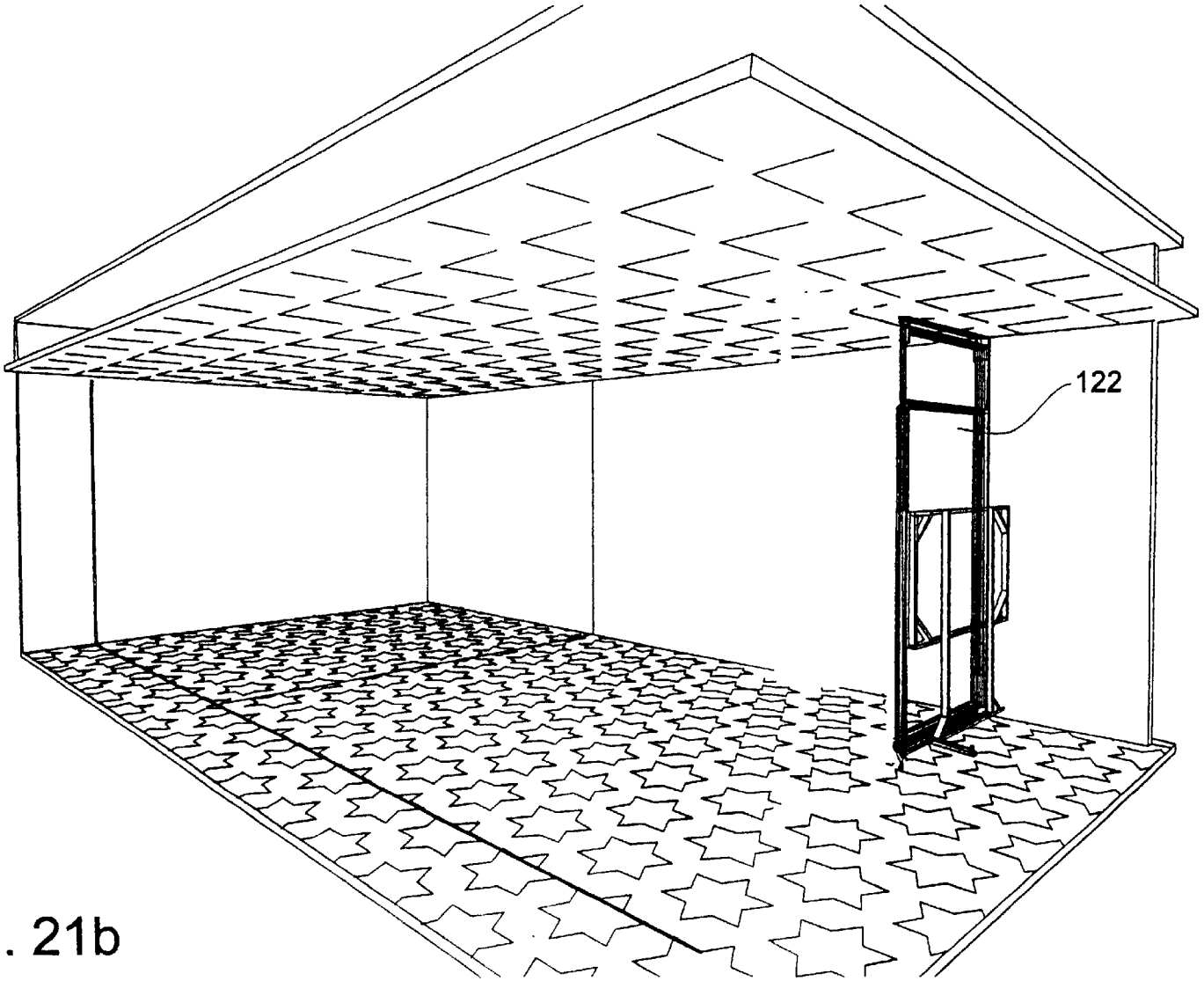

FIGS. 21A–21D illustrate the method of assembly of the present invention. Firstly, one element, in this case a vertical end post 124, is aligned vertically by conventional leveling techniques (FIG. 21A). Then, a first braced panel unit 122 is connected to end post 124 so as to become aligned therewith. With telescopic extension elements 52 appropriately extended, adjustable feet 66 and upper stops 70 are adjusted to bring base strip 68 and top strip 72 into contact with the underlying and overhead surfaces, respectively (FIG. 21B). It will be noted that this adjustment is merely to support the panel unit in its already defined state of alignment and does not require any measurement. Once this adjustment is complete, template 120 could be removed to leave the panel unit 12 correctly supported by the underlying surface. However, where further units are to added to the partition, the template is preferably left in place to provide enhanced rigidity until the next panel unit is properly aligned and supported.

Figure 21C:
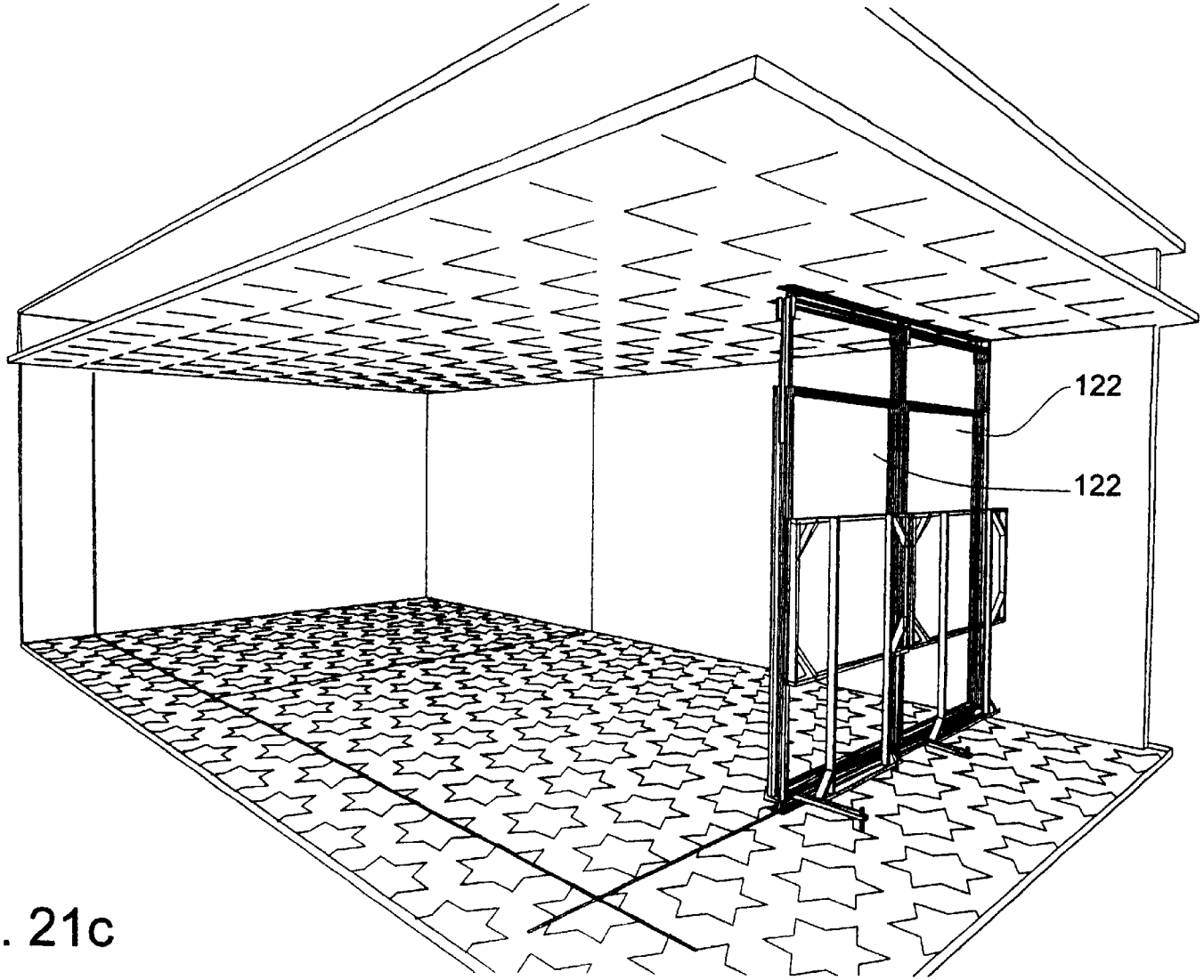
Figure 21D:
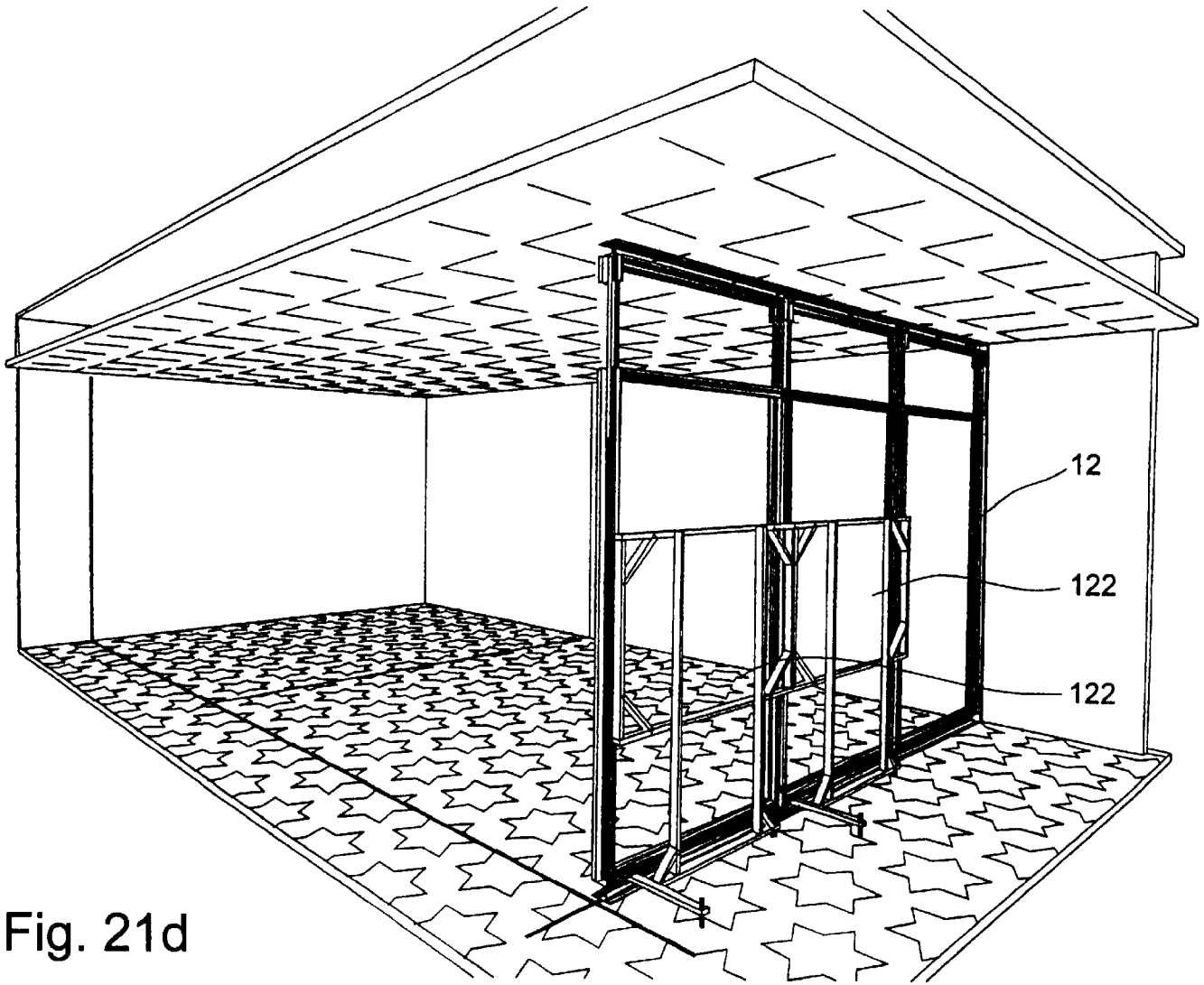

FIG. 21C shows a subsequent stage of assembly in which a second braced panel unit 122 has been attached to the first braced panel unit 122. Each unit in turn takes its alignment from the previous one. Once the second panel is supported, template 120 may be removed from the previous panel unit and attached to a further panel unit for addition to the partition as shown in FIG. 21D. Once the partition reaches the required length, all templates 120 are removed to leave a self-supporting, fully-aligned partition.

For clarity of presentation, panel units 12 have been shown here with panels 22 removed. However, it should be appreciated that the attachment of template 120 to the panel unit is preferably at the sides of the panel unit such that complete panel units can be assembled, dissembled and reassembled using template 120 without taking apart of the panel units themselves.

It will be appreciated that the above descriptions are intended only to serve as examples, and that many other embodiments are possible within the spirit and the scope of the present invention.

What is claimed is:

1. A modular partition system comprising:

(a) at least two relocatable panel units, each of said panel units including:

(i) a substantially rectangular frame formed from two substantially horizontal frame elements and two substantially vertical frame elements interconnected so as to define a substantially rectangular opening, and (ii) at least one panel mounted so as to substantially occlude said opening; and (b) at least one connector for rigidly connecting adjacent ones of said substantially vertical frame elements from said at least two panel units so as to combine said panel units to form a partition, wherein said substantially vertical frame elements are configured to provide attachment portions accessible from the front of said panel unit for receiving said at least one connector such that connection of said panel units may be achieved without dissembly of said panel units.

2. The modular partition system of claim 1, wherein each of said attachment portions includes at least one flange deployed vertically and in a plane substantially perpendicular to a plane of said opening, and wherein said at least one connector is implemented as a plurality of connector brackets configured for engaging two of said flanges.

3. The modular partition system of claim 2, wherein at least one of said connector brackets is implemented as a projecting connector bracket configured to project outwards from the partition system to support at least one partition accessory.

4. The modular partition system of claim 2, wherein each of said connector brackets includes a spacer projection for insertion between said two flanges so as to produce a pre-defined clearance gap between said flanges.

5. The modular partition system of claim 4, wherein each of said two flanges features at least one profiled cut-out configured to provide upper and lower abutment surfaces for abutting corresponding surfaces of said connector brackets such that engagement of said connector brackets within corresponding ones of said profiled cut-outs for two adjacent vertical frame elements locks said flanges against relative vertical movement.

6. The modular partition system of claim 1, wherein each of said substantially vertical frame elements is formed with at least one vertical channel for housing electrical wiring, the system further comprising a cover element configured for attachment to said substantially vertical frame elements so as to cover said vertical channels.

7. The modular partition system of claim 1, further comprising a rigid template configured to temporarily engage at least one of said substantially rectangular frames so as to confine said substantially rectangular frame to a rectangular form during connection of said panel units.

8. The modular partition system of claim 1, wherein each of said panel units further includes an adjustable base section deployed beneath a lower of said two substantially horizontal frame elements, said adjustable base section having:

(a) adjustable support elements adjustable to conform to a gap between said lower substantially horizontal frame element and an underlying surface; and (b) two overlapping plinth elements, a degree of overlap between said overlapping plinth elements varying according to a state of said adjustable support elements, wherein at least one of said overlapping plinth elements is hingedly mounted such that said overlapping plinth element can be swung outwards to provide access to an internal volume of said adjustable base section.

9. The modular partition system of claim 1, wherein each of said panel units further includes:

(a) two telescopic extension elements, each mounted with respect to one of said substantially vertical frame elements so as to be extendible vertically above an upper one of said substantially horizontal frame elements;

(b) fastening means for fastening said telescopic extension elements in a desired position relative to said substantially vertical frame elements; and (c) a supplementary substantially horizontal frame element connecting between said two telescopic extension elements such that said supplementary substantially horizontal frame element, said two telescopic extension elements and said upper substantially horizontal frame element form a secondary substantially rectangular opening.

10. The modular partition system of claim 9, wherein each of said panel units further includes an adjustable upper closure section deployed above said supplementary substantially horizontal frame element, said adjustable upper closure section including:

(a) adjustable upper support elements adjustable to conform to a gap between said supplementary substantially horizontal frame element and an overhead surface; and (b) two overlapping plinth elements, a degree of overlap between said overlapping plinth elements varying according to a state of said adjustable upper support elements, wherein at least one of said overlapping plinth elements is hingedly mounted such that said overlapping plinth element can be swung outwards to provide access to an internal volume of said adjustable upper closure section.

11. The modular partition system of claim 1, wherein each panel unit further includes a plurality of panel clips for retaining said panel within said opening, each of said panel clips including:

(a) a substantially sheet-like insertable tab, said tab having a resiliently biased tongue resiliently biased to an out-of-plane position, said tongue featuring a barbed projection; and (b) a clamping tab attached to, or integrally formed with, said insertable tab, said clamping tab projecting laterally from said insertable tab for abutting a front surface of said panel.

12. The modular partition system of claim 1, wherein each of said panel clips further includes an opening through said panel clip adjacent to the attachment of said clamping tab to said insertable tab, said opening being configured to allow insertion of a tool for removal of said panel clip.

13. The modular partition system of claim 2, wherein each of said flanges features a profiled cut-out shaped to provide:

(a) a first pair of parallel abutment surfaces and a second pair of parallel abutment surfaces, said second pair of parallel abutment surfaces being substantially perpendicular to said first pair of parallel abutment surfaces; and (b) an insertion channel open to an edge of said flange and configured to allow insertion of one of said connector brackets through a twist-in motion to a position abutting all of said first and second pairs of abutment surfaces.

* * * * *